US006565315B1

(12) United States Patent
Bertels et al.

(10) Patent No.: US 6,565,315 B1
(45) Date of Patent: May 20, 2003

(54) ROTATION DEVICE

(75) Inventors: Augustinus Wilhelmus Maria Bertels, Doorwerth (NL); Uwe Stephan, Erdmannsdorf (DE)

(73) Assignee: Willy Vogel AG, Berlin (DE)

( * ) Notice: Subject to any disclaimer, the term of this patent is extended or adjusted under 35 U.S.C. 154(b) by 0 days.

(21) Appl. No.: 09/743,797

(22) PCT Filed: Jul. 28, 1999

(86) PCT No.: PCT/EP99/05493

§ 371 (c)(1),
(2), (4) Date: Mar. 14, 2001

(87) PCT Pub. No.: WO00/06907

PCT Pub. Date: Feb. 10, 2000

(30) Foreign Application Priority Data

Jul. 28, 1998 (NL) ..... 1009759

(51) Int. Cl.[7] ..... F04D 29/44

(52) U.S. Cl. ..... 415/206; 415/211.2; 415/221; 416/198 R; 417/366; 417/572; 417/423.1

(58) Field of Search ..... 415/203, 206, 415/208.2, 211.2, 915, 220, 221; 416/198 R, 235, 236 R; 417/366, 572, 423.1

(56) References Cited

U.S. PATENT DOCUMENTS 2,857,849 A * 10/1958 Pezzillo ..... 417/423.11
3,243,102 A * 3/1966 McMahan ..... 415/208.2
3,316,849 A * 5/1967 Cooper et al. ..... 417/202
3,398,694 A * 8/1968 Lerch ..... 417/366

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A rotation device including first and second passages and a rotor shaft with a rotor which connects onto the first passage with a third passage which branches into rotor channels from the third to a fourth passage. The end zones of the third and fourth passages extend axially. The rotation device has a stator including a first central body with an outer surface which co-bounds a passage space with stator blades which have on one end zone forming a fifth passage a direction differing from the axial direction and on another end zone forming a sixth passage a direction differing little from the axial direction. The fifth passage connects onto the fourth passage and the sixth passage connects onto the second passage. The stator includes a second central body where between the sixth passage and the second passage extend manifold channels bounded by the second central body and the housing.

44 Claims, 29 Drawing Sheets

FIG. 12B
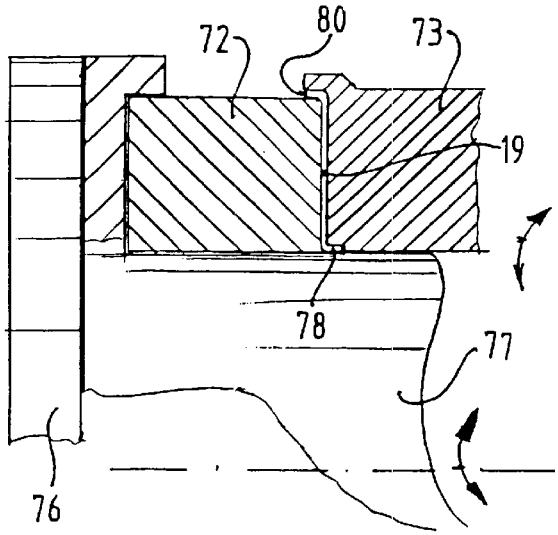
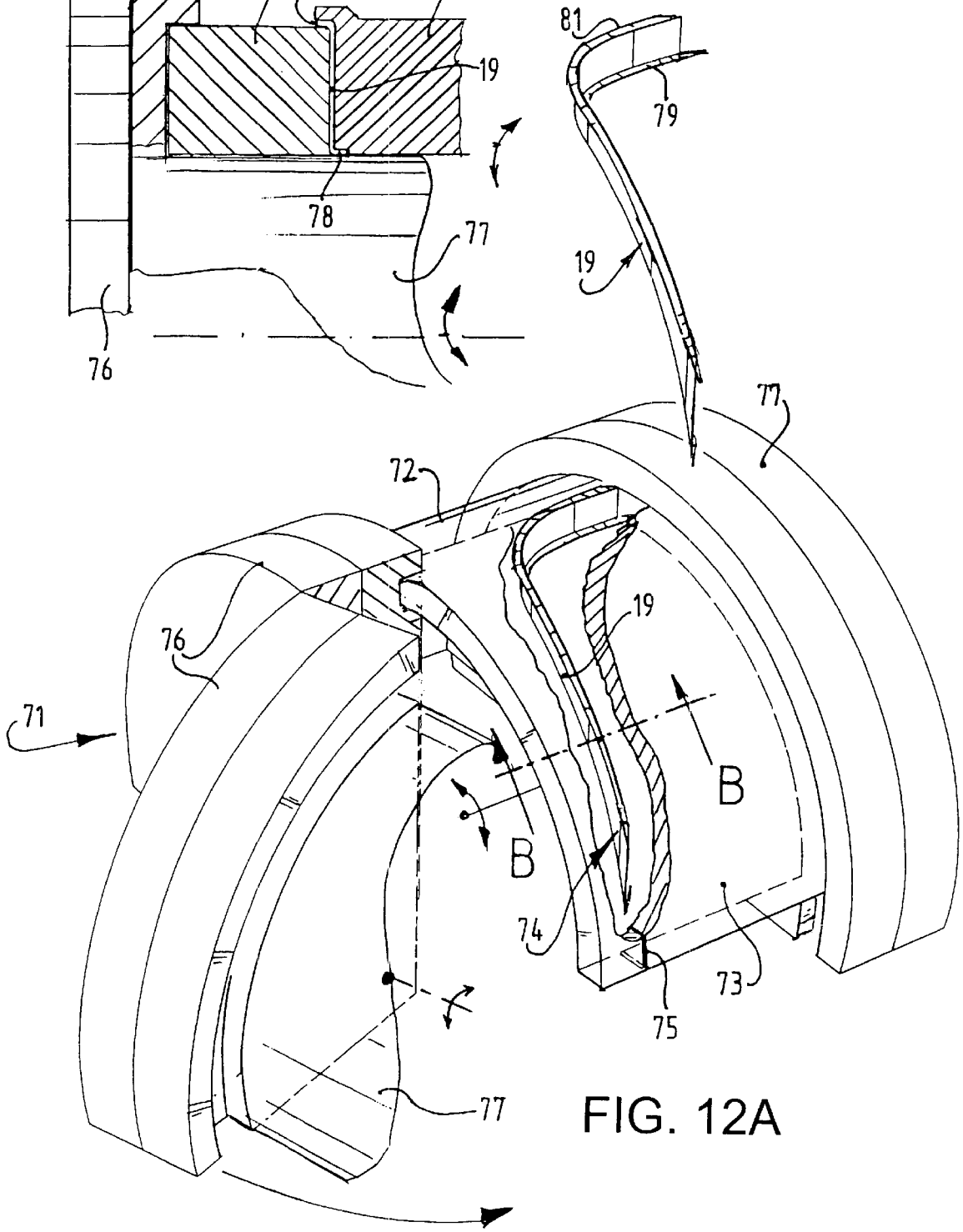
FIG. 12A

FIG. 13B
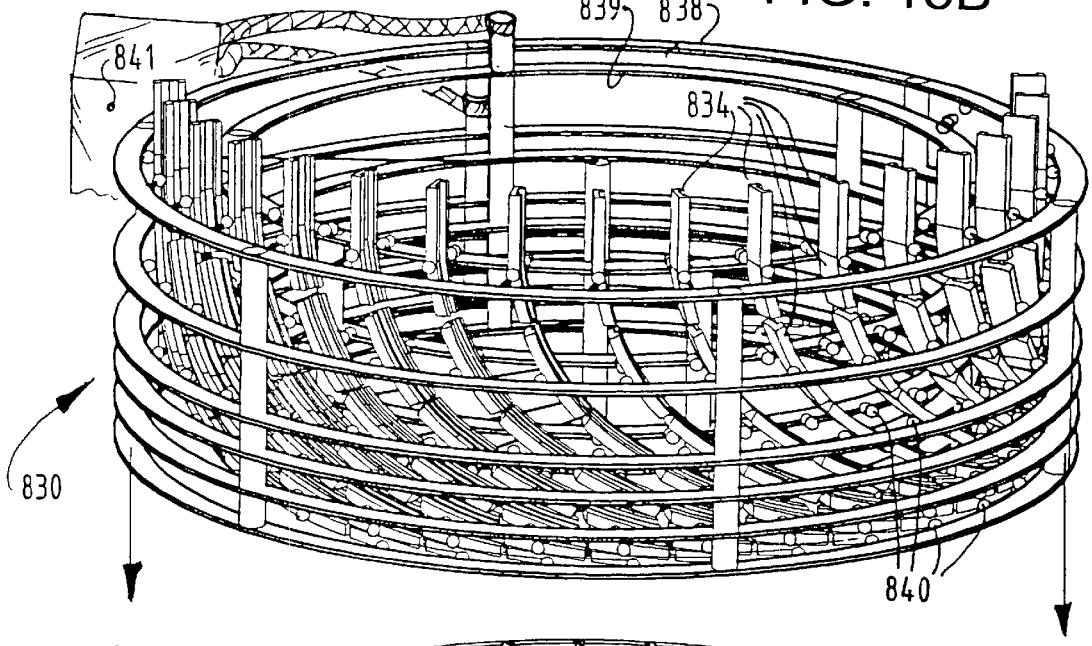
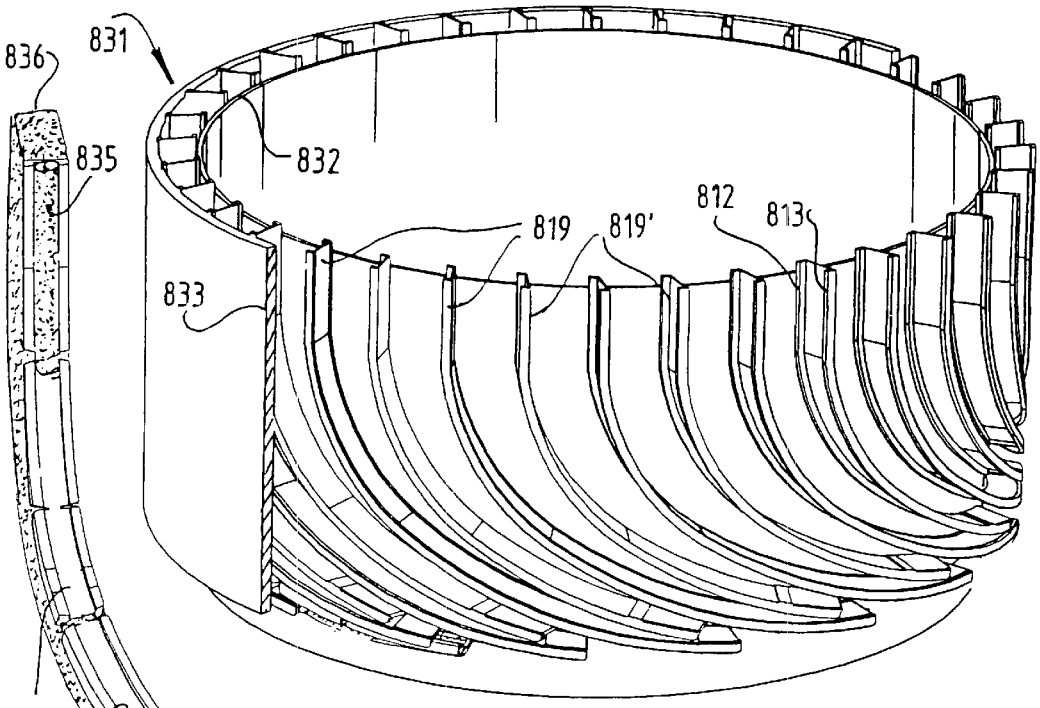
FIG. 13C
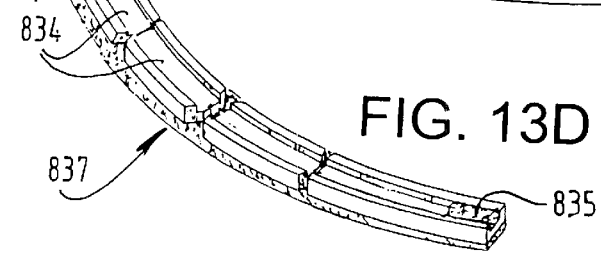
FIG. 13D

ROTATION DEVICE

BACKGROUND OF THE INVENTION

Rotation devices are known in many embodiments.

A centrifugal pump is for instance known with an axial inlet and a rotor with blades for flinging a liquid for pumping radially outward under the influence of centrifugal forces, and one or more for instance tangential outlets.

Further known is an axial compressor having groups of rotor and stator blades ordered in cascade. The structure comprises many thousands of components of extremely complex form which must moreover comply with high standards of dimensional accuracy and mechanical strength. An example hereof is a gas turbine, wherein in this case gaseous medium under pressure is delivered by a source intended for this purpose and is directed onto the blades of a rotor such that this rotor is driven with force, for instance to rotatingly drive a machine such as an electric generator.

These known devices display flow instabilities, particularly at low flow rates. These usually cause an imbalance in the rotor load which gives rise to heavy vibrations, uncontrollable variations in rotation speed and very heavy mechanical loads on bearings, shafts and blades.

All known rotation devices also have further certain technical shortcomings.

The efficiency is for instance often relatively low and greatly dependent on the speed of rotation.

The known devices are moreover usually voluminous, heavy and expensive.

In the use of casting techniques to manufacture a rotor the blades must have a certain minimal wall thickness, which gives rise to undesirable reductions in the effective through-flow volume and losses due to release and wake-forming. The blade wall thickness and the required blade form moreover limit the number of blades which can be accommodated. In addition, the casting technique unavoidably results in undesired surface roughness and imbalance as a consequence of unintended and unmanageable differences in density, for instance as a result of inclusions.

The tensile strength of cast metals and alloys is also limited.

Known centrifugal pumps are further affected by so-called slippage, the phenomenon of the flow having little adhesion to the suction side of the flow channel bounded by adjoining blades. Owing to the expansion angle between the blades there is a slippage area or an area with "stagnant" water in which a large-scale stationary turbulence is located, whereby the through-flow in that area is zero. The outlet pressure of the centrifugal pump is strongly pulsating as a result.

In addition, known devices are constructed such that they produce a great deal of noise during operation.

All known devices operating for instance as water pumps have a limited pressure capacity. For applications as fire service pump for instance, pumps are therefore often placed in cascade with one another in order to realize the required pressure, also expressed as lift of the water for pumping.

In the known rotation devices it is sometimes also perceived as a drawback that medium inlet and medium outlet do not have the same direction but are directed for instance at right angles to each other. In determined conditions it may be desired to at least have the option of giving the inlet and the outlet the same direction.

Known devices are further unable to operate with media having greatly varying viscosities.

In known devices the flow speeds of the through-flowing media vary very considerably during through-flow of a device. Noise production and efficiency loss result as a consequence of the accelerations which occur. It would be desirable in this respect to keep the through-flow speed of media flowing through a rotation device constant under all conditions, for instance within a range of 0.2–5 times a target value.

SUMMARY OF THE INVENTION

It is an object of the invention to provide a rotation device which either does not possess the above stated problems and limitations of the prior art or at least does so to a lesser extent.

In respect of the above the invention generally provides a rotation device.

The device can for instance be employed as pump or compressor.

The device relates to a device operating as a motor.

The invention can relate to different media for pumping. The term "two-phase medium" relates for instance to media which may be liquid and/or gaseous depending on operating temperature and operating pressure. Such media are much used in cooling systems. Examples are freons, ammonia, alkanes.

The present invention defines in general terms a possible form of the rotor channels and gives increasing preferences for the number of rotor channels.

The present invention relates to a structure of the rotation device which prevents strong periodic pressure pulsations during operation. Such a structure ensures a low-noise and uniform flow.

The invention further relates to the application of an infeed propellor in the medium inlet in the case of a rotation device serving as medium pump. The infeed propellor ensures that the medium enters the rotor channels without release at a certain pressure and speed.

A very practical embodiment relating to a light and easily manufactured rotor is described herein.

Since it is important that in the region of the third medium passage no discontinuity occurs which could cause large-scale swirling and turbulences, release and noise production, the structure according to the present invention can be advantageous.

The invention provides a structure of the rotation device wherein a relatively large number of baffles can be used without the thickness of the baffles at the position of the third medium passage substantially reducing the passage for medium at that position. As a result of the transverse dimension becoming wider in radial direction relative to the axial direction of the rotor channels, additional space is available for interwoven placing of a second group of second baffles at a distance from the third medium passage. As far as is necessary, a third group of baffles can also be placed between the interwoven first and second baffles. These baffles are in turn shorter than the second baffles and extend in the direction of the third to the fourth medium passages as far as the fourth medium passage at a distance from the end of the second baffles directed to the third medium passage. This structure enables a very good flow guiding without this essentially having an adverse effect on the effective passage of the medium.

The invention also relates to the form of the stator blades. Since all stator blades are placed in angularly equidistant manner, their mutual distance is always the same in any axial position. Rheologically however, it is essential that, as seen in the direction from the fifth medium passage to the sixth medium passage, an effective fanning out occurs in a direction as seen along a flow line in a stator channel. Perpendicularly of such a flow line an angle of progression can be defined at any position along this flow line between the blades. The structure has the advantage of a considerably improved efficiency.

The use of plate material for manufacture of the dishes and the blades according to the invention has the advantage that the rotor can be very light. Plate material can further be very light, smooth and dimensionally reliable. The choice of material will be further determined by considerations of wear-resistance (depending on the medium passing through), bending stiffness, mechanical strength and the like. For the rotor, the dishes of which have the described double-curved form, it is important that the principal form is retained, even when the material is subjected to centrifugal forces as a result of high rotation speeds. In this respect attention is drawn to the fact that the blades, which are arranged between the dishes and rigidly coupled thereto, contribute to a considerable degree towards stiffening of the rotor. For this reason also it is important to use a large number of blades. A rotor can also be manufactured with very high dimensional accuracy and negligible intrinsic imbalance.

The invention also provides options relating to choices of material under specific conditions.

Depending on the dimensions of the rotor and the rotation speed, the described plate material can have a desired value. An appropriate choice lies generally in the range stated herein. In respect of the possibility of a small imbalance, the mass moment of inertia of the rotor is preferably as small as possible, particularly in the case of media with low density such as gases. In this context it is recommended to choose the technically smallest possible thickness.

The invention provides several possible techniques with which the rotor baffles can be coupled to the dishes.

The invention provides possible choices of material for the stator blades. The technical considerations forming the basis of this choice are by and large the same as those for the rotor baffles.

The invention relates to the material choices of or at least the materials on the cylindrical inner surface of the housing and of the stator blades. By setting the thermal expansion coefficients of these materials, thermal stresses are avoided and it is ensured that the mutual connection and the correct shape of the stator channels also remain preserved in the case of extreme temperature variations.

The invention provides as a specific development of the described technical principle the possibility of the materials being the same. It will be apparent that in a further development not only the cylindrical inner surface of the housing must be of the relevant material but this can also be the case for the whole cylindrical jacket of the housing, or even the whole housing.

The invention relates to the form of the stator channels.

As already described above, the mass moment of inertia, and therewith the danger of a certain imbalance of the rotor, is preferably as small as possible.

The invention further relates to this same aspect and applies particularly to gas as medium, which after all makes no appreciable contribution to the mass moment of inertia. Although as a result of the small radial dimensions the shaft should have a considerable weight in order to have a mass moment of inertia in the same order of magnitude as that of the rotor, it should nevertheless be understood that the contribution in question can be substantial in respect of the length of the shaft which in some conditions is relatively great. In addition, the rotor will preferably take the lightest possible form so that for this reason its mass moment of inertia will also be relatively small.

The invention provides several possibilities for forming the rotor dishes.

The invention also provides a very specific method of forming a rotor.

Particularly in the case of a very hot or very cold medium, the structure according to an embodiment of the invention is significant.

The invention provides a very advantageous embodiment wherein an effective sealing is combined with a friction which practically amounts to zero.

The invention provides in increasing preference possible numbers of stator blades. In By the design of the rotation device according to the invention account must be taken of the fact that a local flow tube is then only controllable over a wide flow range if the flow tube is elongate.

The invention provides further characterizations of the rotation device in terms of the ratio of the total cross-sectional surface of all fourth medium passages and the third medium passage. The relevant choice is greatly dependent on design requirements.

The present invention further provides options relating to the ratio of the diameter of the ring of fourth medium passages and the diameter of the third medium passage. The relevant choice depends on the pressure ratio to be generated between the inlet and outlet in the case of a pump or the expansion ratio in the case of a turbine.

In the pump according to the inventio there is still strong rotation in the region of the fourth and fifth medium passages. This results locally in a relatively low static pressure, in contrast to the known centrifugal pump. As a resuly of the local relatively low pressure relatively small demands are made of the thicknesses of the relevant walls and the local seals, whereby use can for instance be made of simple seals such as labyrinth seals, which in particular conditions are considered low-grade. As is known, because of its nature a labyrinth seal is not completely closed. As a consequence of the relatively low local pressure the seal is nevertheless sufficient when labyrinth seals are used.

Said small wall thicknesses enable manufacture by deep-drawing.

The device according to the invention can be applied very widely. As pump it displays a very even pressure and efficiency characteristic and a more[]or less monotonous power characteristic, whereby one pump is suitable for many very varied applications, while in usual pumps different dimensioning is required for different applications.

The said monotonous, substantially linear characteristic at any rotation speed provides the important option, by means of a very simple adjustment of the driving power, of achieving an output performance corresponding substantially unambiguously therewith. The prior art requires for this purpose a complicated and expensive adjustment based on the momentary values of a number of relevant parameters. This is the reason why such adjustments are not applied in practice.

For pumping of media with very varying viscosities only a limited number of differently dimensioned pumps is necessary as a consequence of the small dependence of the properties of the device on the viscosity of the medium.

In the use as pump, one device can realize a very large flow rate and/or a very high pressure comparable to the cascading of a plurality of pumps as according to the prior art.

In order to reverse the operation of a pump to that of a motor or vice versa, some modification of the dimensioning of stator channels and rotor channels will generally be desirable.

BRIEF DESCRIPTION OF THE DRAWINGS

The invention will now be elucidated with reference to the annexed drawings. In the drawings:

FIG. 12A is a partly schematic perspective view of a mould for forming rotor blades;

FIG. 12B shows a cross-section along the line B—B in FIG. 12A;

FIG. 13B is a schematic, partly perspective view of an arrangement of a number of conducting blocks in the manufacturing phase of a stator;

FIG. 13C is a partly broken away perspective view drawn under FIG. 13B of the stator manufactured as according to FIG. 13B;

FIG. 13D shows an assembly of blocks conducting heat and electricity as according to FIG. 13B;

DETAILED DESCRIPTION OF THE INVENTION

Figure 1:
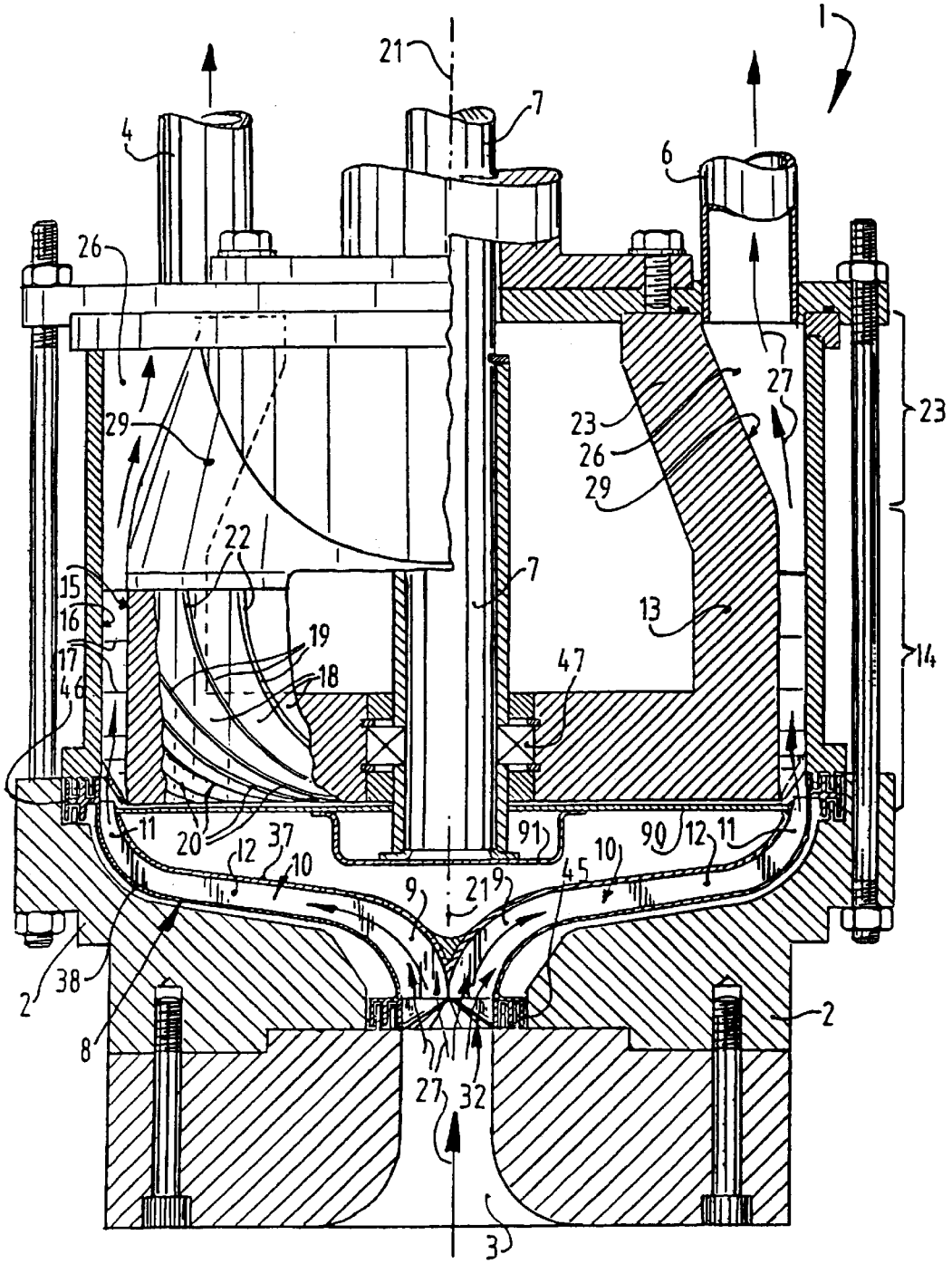
FIG. 1 shows partly in cross section and partly in cut away side view a first embodiment of a rotation device.

FIG. 1 shows a rotation device 1. This comprises a housing 2 with a central, axial first medium passage 3 and three axial second medium passages 4, 5, 6. The device 1 further comprises a shaft 7 which extends in said housing 2 and outside of this housing 2 and which is mounted for rotation relative to housing 2 and supports a rotor 8 accommodated in housing 2, which rotor will be specified hereinbelow. Rotor 8 connects with a central third medium passage 9 to the first medium passage 3. The third medium passage 9 branches into a plurality of angularly equidistant rotor channels 10 which each extend in a respectively at least more or less radial main plane from the third medium passage 9 to a respective fourth medium passage 11. The end zone of the third medium passage 9 and the end zone of the fourth medium passage 11 each extend substantially in axial direction. As FIG. 1 shows, each rotor channel 10 has a generally slight S-shape roughly corresponding with a half-cosine function, and has a middle part 12 which extends in a direction having at least a considerable radial component. Each rotor channel has a cross-sectional surface which enlarges from the third medium passage to the fourth medium passage.

Rotation device 1 further comprises a stator 13 accommodated in housing 2. This stator 13 comprises a first central body 14 and a second central body 23.

The first central body 14 has on its zone adjoining rotor 8 a cylindrical outer surface 15 which, together with a cylindrical inner surface 16 of housing 2, bounds a generally cylindrical medium passage space 17 with a radial dimension of a maximum of 0.2 times the radius of the cylindrical outer surface 15, in which medium passage space 17 are accommodated a plurality of angularly equidistant stator blades 19 which in pairs bound stator channels 18, and which stator blades 19 each have on their end zone 20 directed toward rotor 8 and forming a fifth medium passage 24 a direction differing substantially, in particular at least 60°, from the axial direction 21, and on their other end zone 22 forming a sixth medium passage 25 a direction differing little, in particular a maximum of 15°, from the axial direction 21, which fifth medium passages 24 connect onto the fourth medium passages 11 and which sixth medium passages 25 connect to the three second medium passages 4, 5, 6.

The second central body is embodied such that between the sixth medium passage 25 and the second medium passages 4, 5, 6 three manifold channels 26 extend tapering in the direction from the sixth medium passages 25 to the second medium passages 4, 5, 6. These manifold channels are also bounded by the outer surface 29 of the second central body 23 and the cylindrical inner surface 16 of housing 2.

FIG. 1 shows a general medium through-flow path 27 with arrows. This path 27 is defined between the first medium passage 3 and the second medium passages 4, 5, 6 through respectively: first medium passage 3, third medium passages 9, rotor channels 10, fourth medium passages 11, stator channels 18, sixth medium passages 25, manifold channels 26, second medium passages 4, 5, 6, with substantially smooth transitions between the said parts. It is noted that in FIG. 1 the flow of the medium according to arrows 26 is shown in accordance with a pumping action of device 1, for which purpose the shaft 7 is driven rotatingly by motor means (not shown). If medium under pressure were to be admitted with force via medium passages 4, 5, 6 into the second medium passages 4, 5, 6, the medium flow would then be reversed and the rotor 8 would be driven rotatingly, also while driving shaft 7 rotatably, by the structure of the device 1 to be described hereinbelow.

The structure of the device is such that during operation there is a mutual force coupling between the rotation of rotor 8, and thus the rotation of the shaft, on the one hand and the speed and pressure in the medium flowing through said medium through-flow path 27.

The device can therefore generally operate as pump, in which case shaft 7 is driven and the medium is pumped as according to arrows 27, or as turbine/motor, in which case the medium flow is reversed and the medium provides the driving force.

Figure 2:
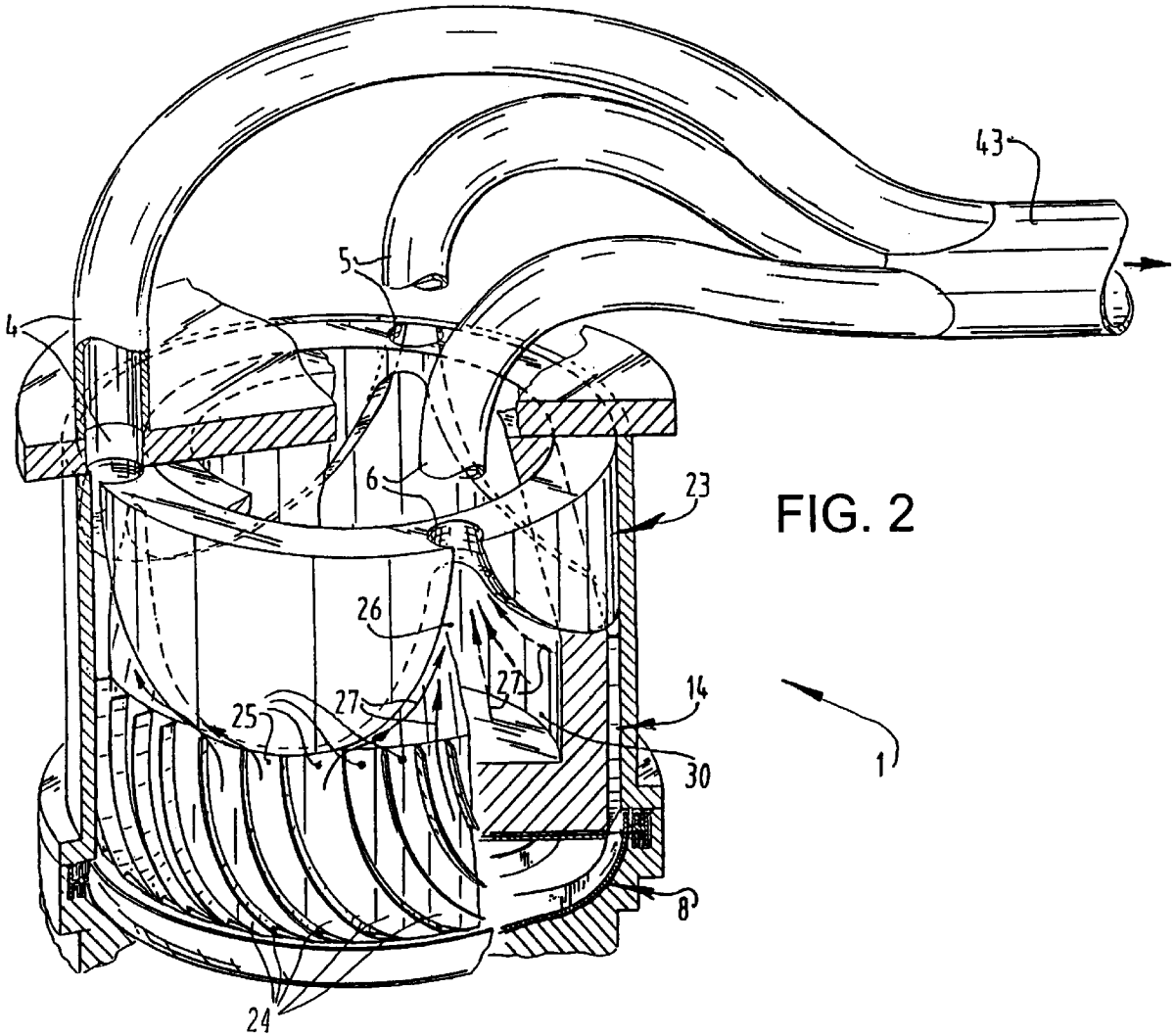
FIG. 2 is a partly broken away perspective view of the device of FIG. 1 which is schematized to illustrate the spatial structure.

FIG. 2 shows device 1 in highly schematic cut-away perspective. It will be apparent that manifold channels 26 are formed by a second central body 23 which can be deemed an insert piece which is situated above the first central body 14 and has three recesses 30 forming the manifold channels 26. These recesses have rounded shapes and connect on their underside to the sixth medium passages 25 for guiding the medium as according to arrows 27 to the second medium passages 4, 5, 6.

Figure 3:
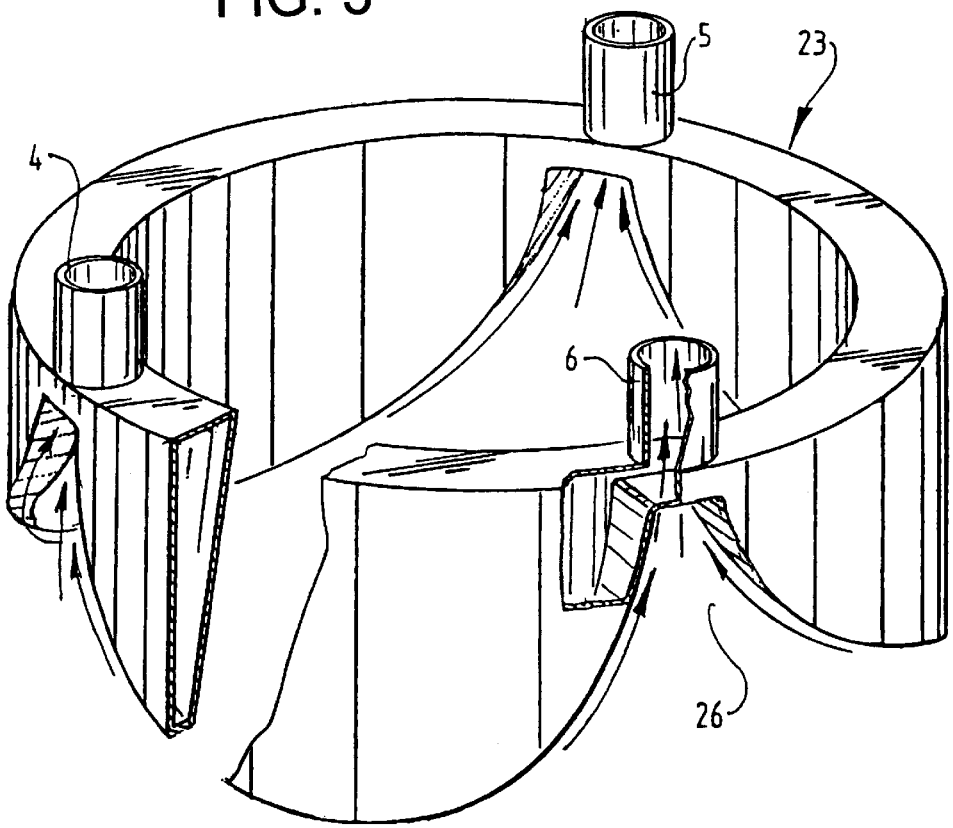
FIG. 3 shows a variant of a manifold.

FIG. 3 shows the insert piece 23 in partly broken away perspective view. In this random embodiment the insert piece 23 is formed from sheet-metal. It can however also consist of other suitable materials such as solid, optionally reinforced plastic and the like.

Figure 4:
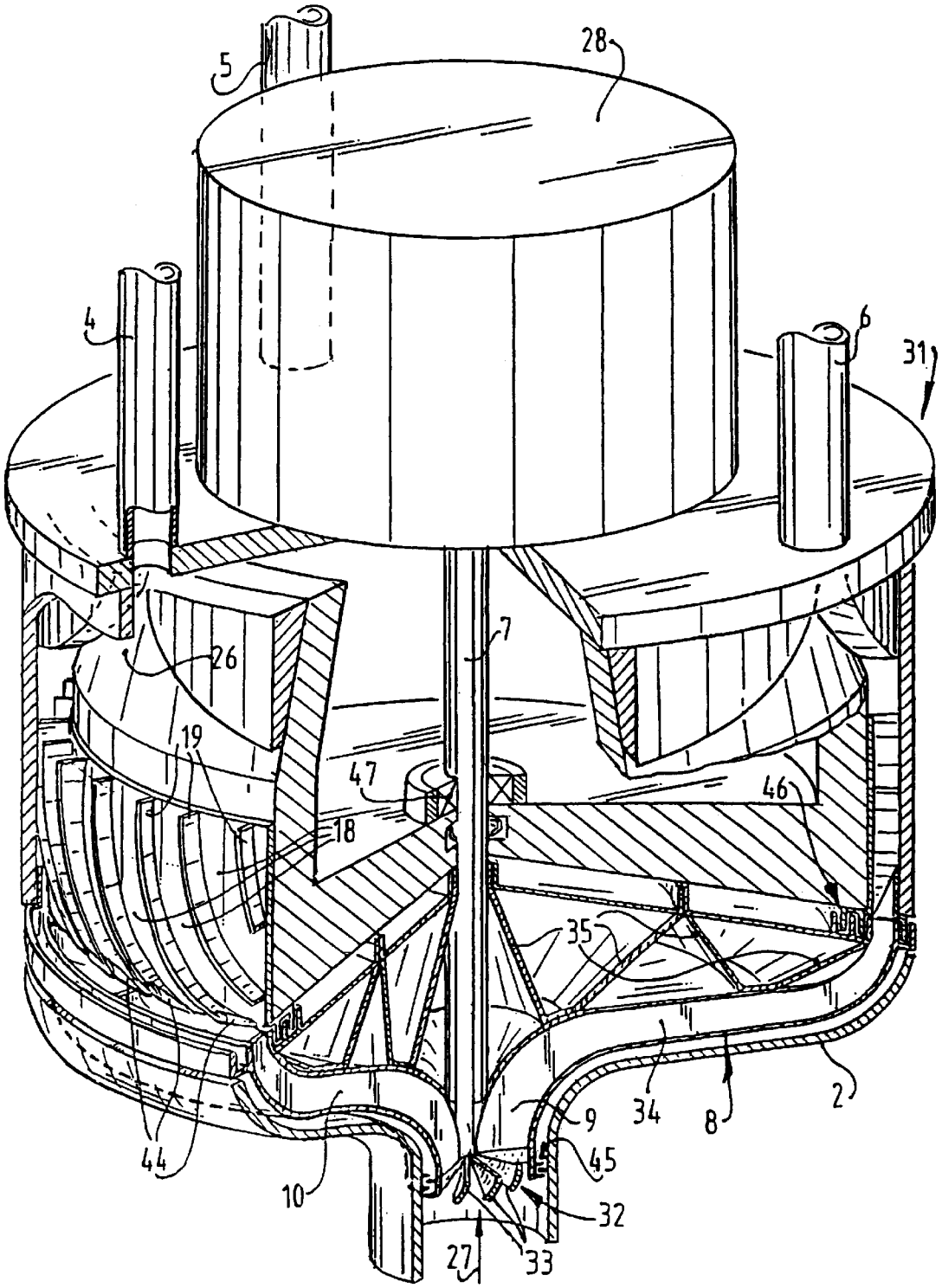
FIG. 4 is a partly broken away perspective view of a second embodiment of a rotation device.

FIG. 4 shows a device 31 which corresponds functionally with the device 1. Device 31 comprises a drive motor 28.

As can be seen more clearly in FIG. 4 than in FIG. 1, an infeed propellor 32 with a plurality of propellor blades 33 is arranged in the third medium passage 9 serving as medium inlet.

Figure 9:
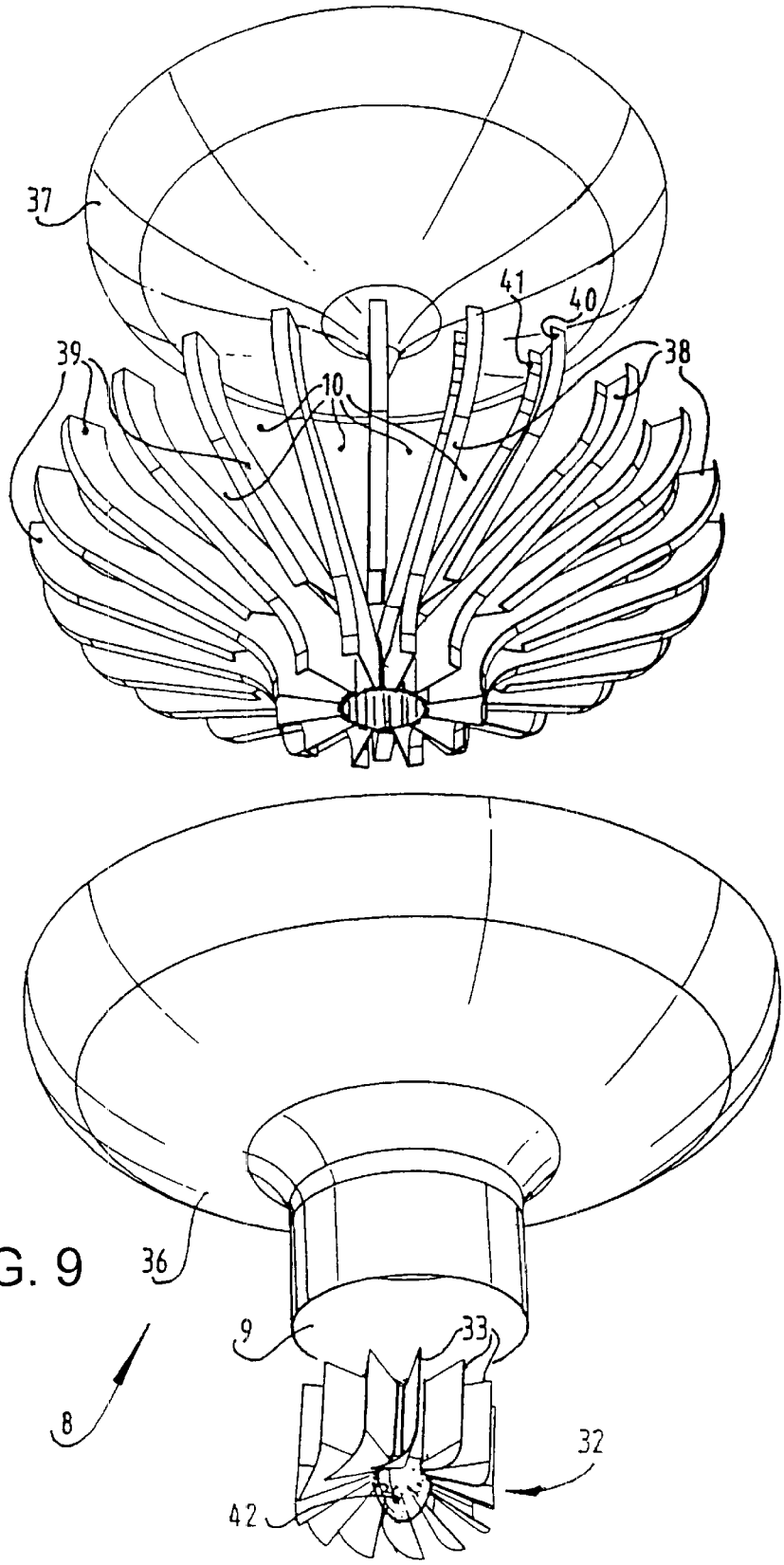
FIG. 9 shows a perspective exploded view from the underside, corresponding with FIG. 7, of the rotor.

In anticipation of the discussion of the rotor according to FIG. 9, which corresponds with rotor 8 according to FIG. 1, it is noted here that rotor 34 in the device 31 according to FIG. 4 has a number of additional strengthening shores 35 which are absent in the rotor 8.

As shown in FIG. 9, rotor 8 comprises a plurality of separate components which are mutually integrated in the manner to be described below. Rotor 8 comprises a lower dish 36, an upper dish 37, twelve relatively long baffles 38 and twelve relatively short baffles 39 placed interwoven therewith, which in the manner shown form equidistant boundaries of respective rotor channels 10. Baffles 38, 39 each have a curved form and edges 40, 41 bent at right angles for medium-tight coupling to dishes 36, 37. Baffles 38, 39 are preferably connected to the dishes by welding and thus form an integrated rotor. In the central third medium passage 9 is placed infeed propellor 32. This has twelve blades which connect to the long rotor baffles 38 without a Theologically appreciable transition. A downward tapering streamlining element 42 is placed in the middle of infeed propellor 32.

FIG. 4 in particular clearly shows the operation of the device 31 operating for instance as liquid pump. By driving shaft 7 with co-displacing of rotor 34 liquid is pressed into the rotor channels through the action of propellor 32. Partly as a result of the centrifugal acceleration which occurs, a strong pumping action is obtained which is comparable to that of centrifugal pumps. However, centrifugal pumps operate with fundamentally differently formed rotor channels. The liquid flowing out of rotor channels 10 displays a strong rotation and takes the form of an annular flow having both a tangential or rotational direction component and an axial direction component. Stator blades 19 remove the rotation component and lead the initially axially introduced flow once again in axial direction inside the manifold channels 26, where the part-flows are collected and supplied to respective medium outlets 4, 5, 6. If desired, the medium can be pumped further via one conduit in the manner shown in FIG. 2 by means of combining the three outlets 4, 5, 6 into one conduit 43. In anticipation of FIG. 10 it is noted that other embodiments are also possible, wherein the outlet also extends in practically exactly axial direction.

Figure 5A:
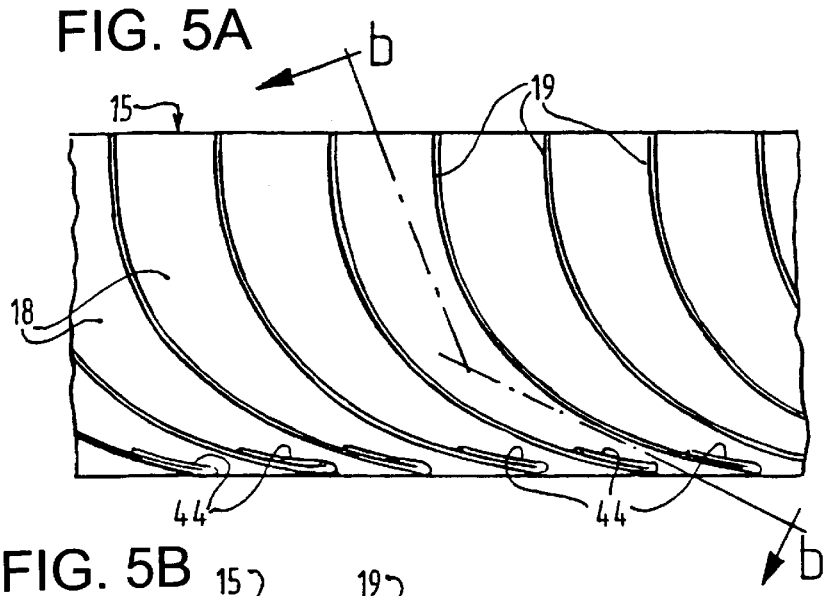
FIG. 5A shows a developed view of a part of a stator with stator blades bounding stator channels.

FIG. 5A shows that stator blades 19 have a bent edge 44 on their infeed side. This edge has a rheological function. It provides a smooth, streamlined transition to the stator channels 18 from the strongly rotating medium flow generated by the rapidly rotating rotor 34.

The described rotors consist in this embodiment of stainless steel components, with reference to FIG. 9 the dishes 36, 37, the baffles 38, 39, the propellor 32.

FIG. 5A shows in developed form the outer surface of the first central body and the stator blades 19.

Figure 5B:
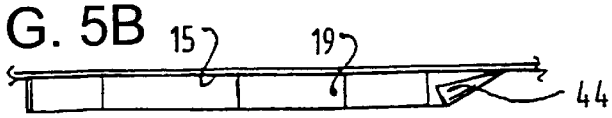
FIG. 5B shows a developed view of a stator blade.

FIG. 5B shows a view of a baffle 19 along the broken line B-B in FIG. 5A.

Figure 5C:
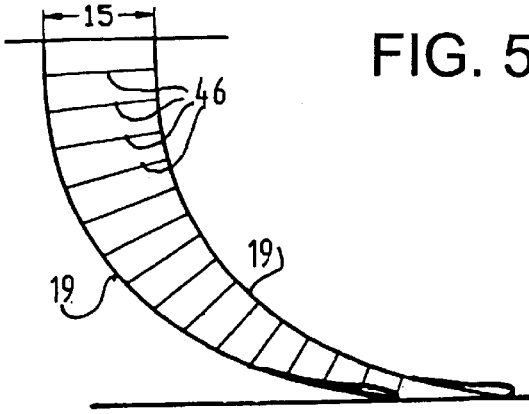
FIG. 5C shows a view corresponding with FIG. 5A of two stator blades for the purpose of elucidating the geometric proportions.

FIG. 5C shows a set of stator blades 19 together bounding a set of stator channels 18.

Figure 5D:
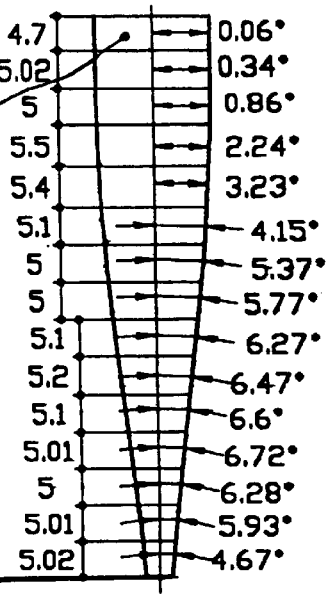
FIG. 5D shows a straight-line view of the stator channel according to FIG. 5C.

FIG. 5D shows a working drawing of channel 18 with the definition of the mutual angles in accordance with the successive lines 46 which, as FIG. 5D shows, all have mutual distances along the axis of about 5 mm, in this embodiment at least. The outlet width of each stator channel is about 15 mm, as shown in FIG. 5C. FIG. 5D shows the different positions with the associated half angles between the blades 19 at the positions indicated.

Figure 5E:
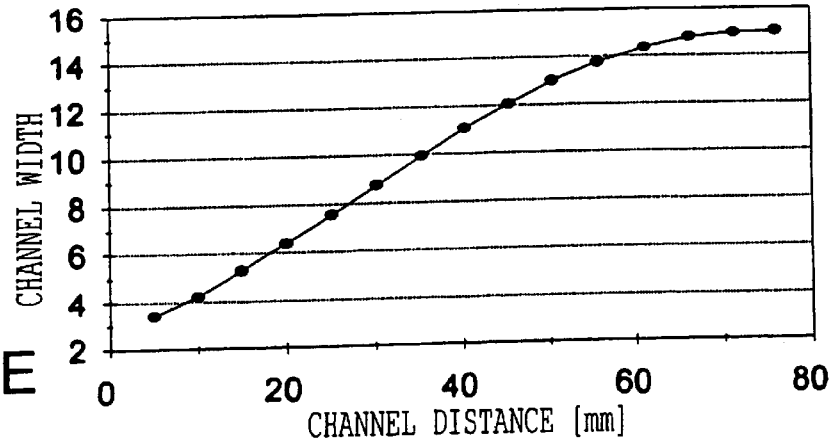
FIG. 5E shows a graph of the channel width as a function of the channel distance.

FIG. 5E shows the channel width as a function of the positions as according to FIGS. 5C and 5D.

Figure 5F:
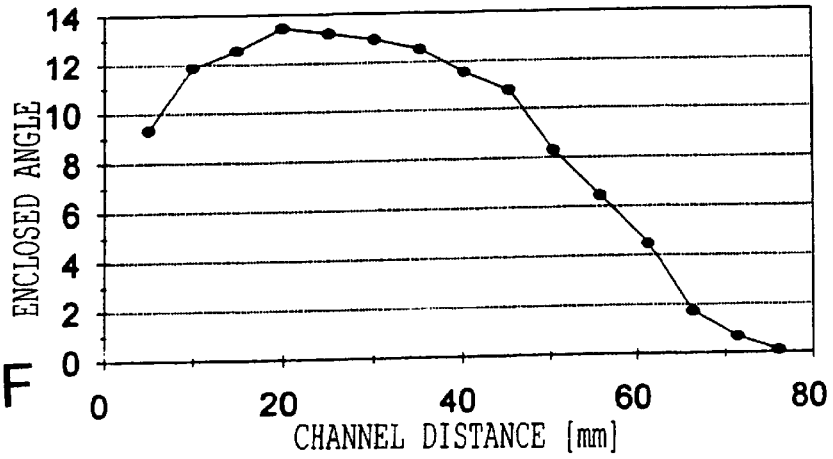
FIG. 5F shows the enclosed angle as a function of the channel distance.

FIG. 5F shows the enclosed angle as according to the view in FIG. 5D. It is important to note that this angle nowhere exceeds the Theologically significant value of about 15° and even remains under the value of 14°.

In FIG. 1 and FIG. 4 can be clearly seen that the respective rotors 8, 34 in the region of the third medium passage and the fourth medium passage are sealed relative to housing 2 by respective labyrinth seals 45, 46. The shaft is mounted relative to the housing by means of at least two bearings, only one of which is drawn in FIGS. 1 and 4. This bearing is designated with reference numeral 47.

Figure 6A:
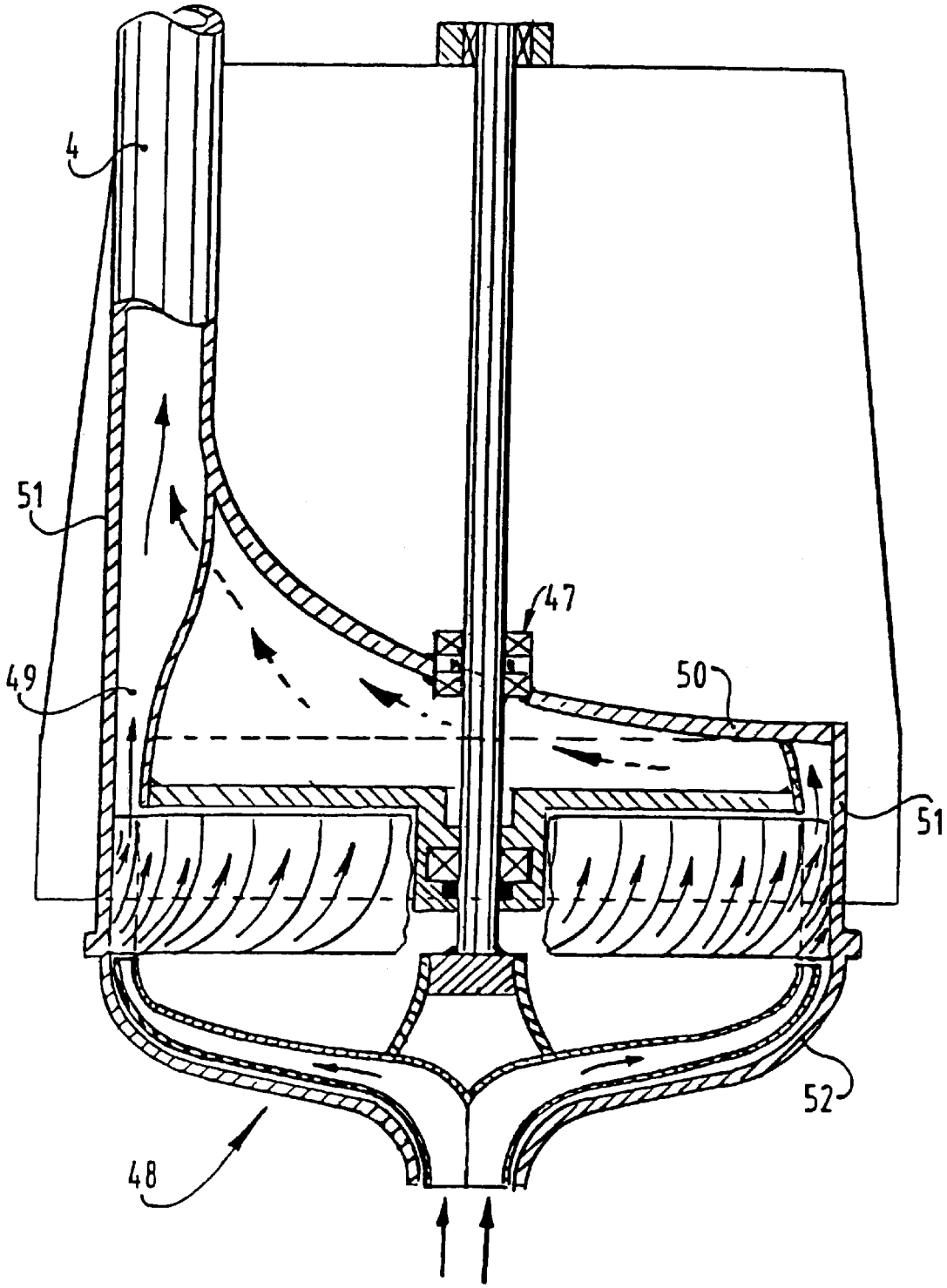
FIG. 6A shows a schematic cross-section of a third embodiment of a rotation device.

FIG. 6A shows a rotation device with a slightly different structure. This structure involves a continuous unit of manifold channels since there is a space 49 which is bounded by a second central body 50 together with the wall 51 of housing 52. There is therefore only one medium outlet 4.

Figure 6B:
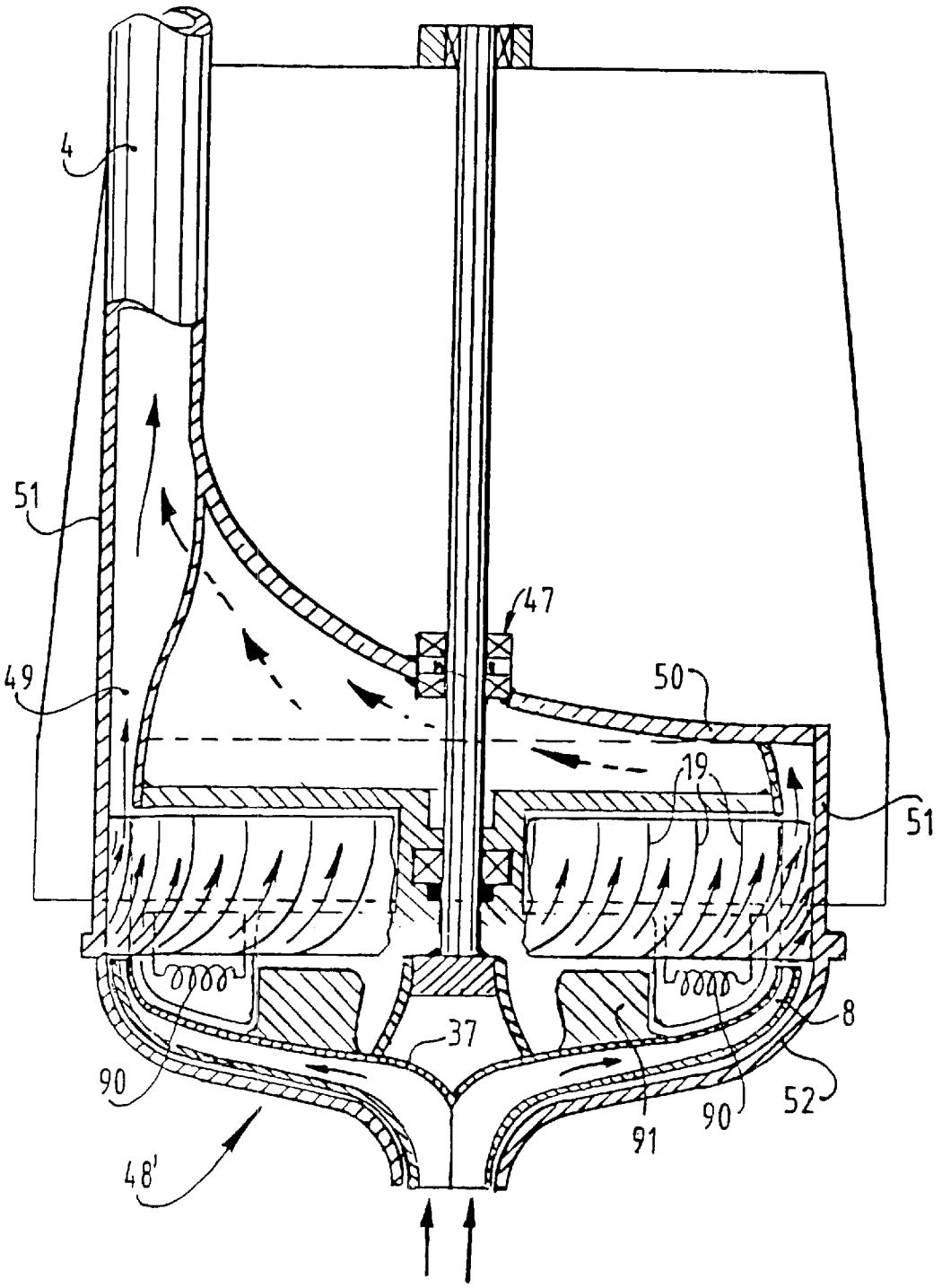
FIG. 6B shows a view corresponding with FIG. 6A of a variant.

FIG. 6B shows a rotation device 48', the structure of which corresponds practically wholly with the structure of device 48 according to FIG. 6A. Other than in device 48, device 48' comprises an electric motor. This comprises a number of stator windings designated with reference numeral 90 which are arranged in stationary position, and a rotor anchor 91 fixedly connected to upper dish 37 of rotor 8.

The connecting wires of the stator windings are not drawn. They can very suitably extend upward via the unused space inside stator blades 19 and exit device 48' at a desired suitable position.

Figure 7:
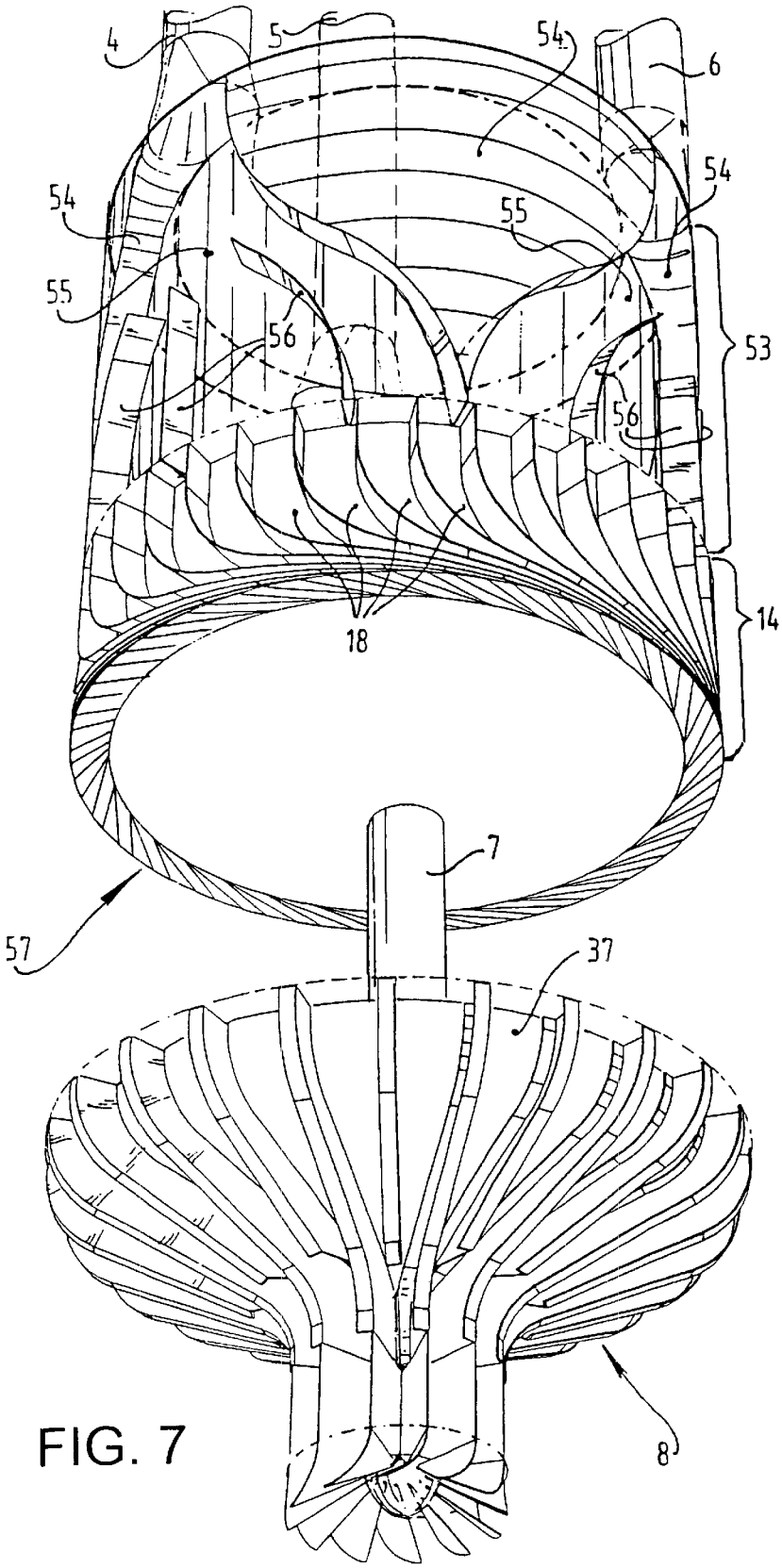
FIG. 7 shows a perspective exploded view from the underside of the internal structure with rotor and stator of a fourth embodiment of a rotation device, with omission of the housing and the lower rotor dish.

FIG. 7 shows the internal structure of rotor 8 with omission of the lower dish 36. Reference is made in this respect to FIG. 9. Particularly important in this FIG. is the structure of the second central body 53. Comparison with FIG. 2 in particular will make clear how this embodiment differs from the structure of device 1. The second central body 53 is provided with three insert pieces 54 bounding recesses 55 which connect the outlet openings of stator channels 18 to medium outlets 4, 5, 6. Recesses 55 are provided with flow guiding baffles which, although they have different shapes, are all designated with the reference numeral 56 for the sake of convenience. A very calm, turbulence-free flow is likewise realized due to this structure.

Figure 8:
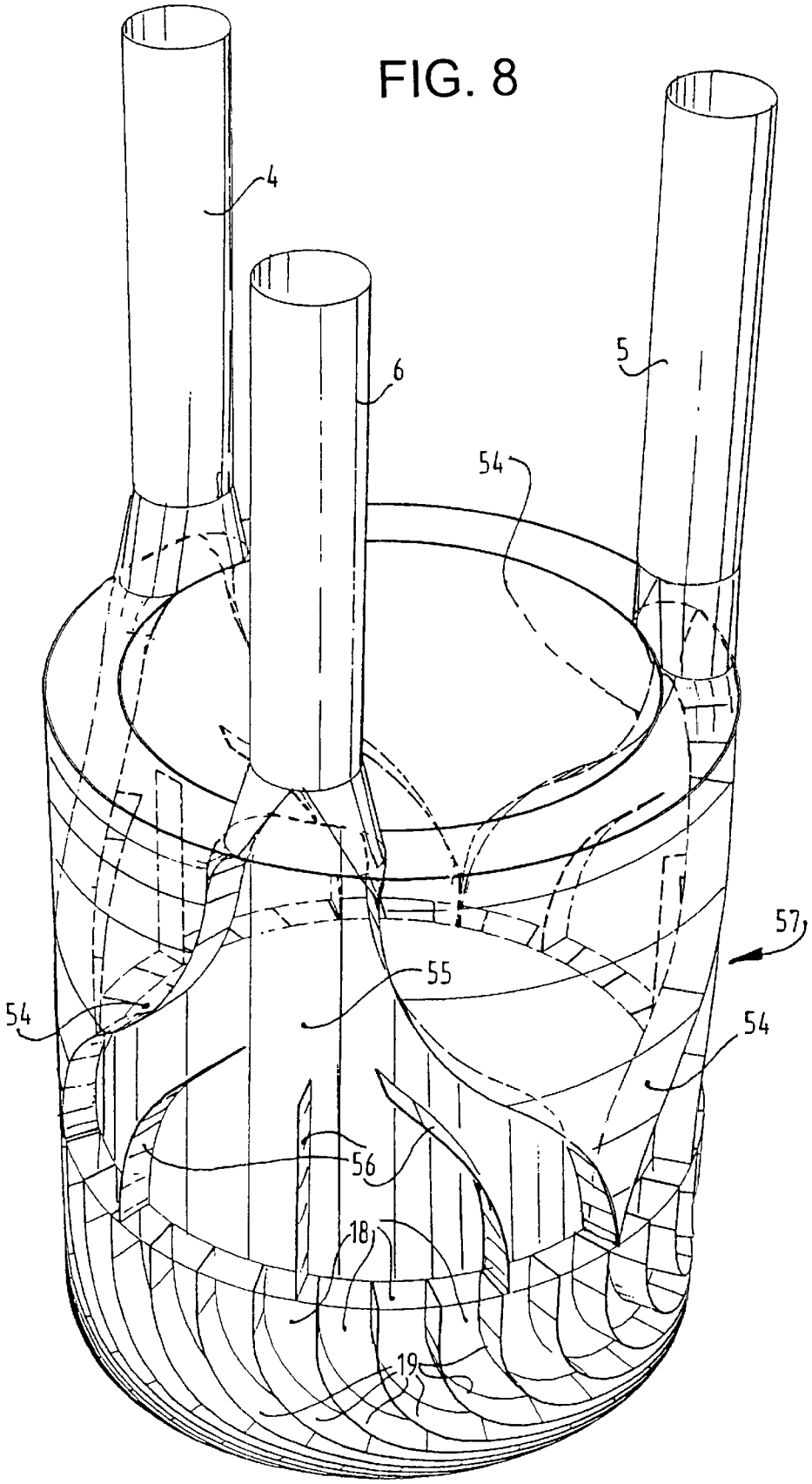
FIG. 8 shows a view from the top of the stator according to FIG. 7, with omission of the housing and the rotor.

FIG. 8 shows the stator 57 according to FIG. 7 from the other side.

Figure 10A:
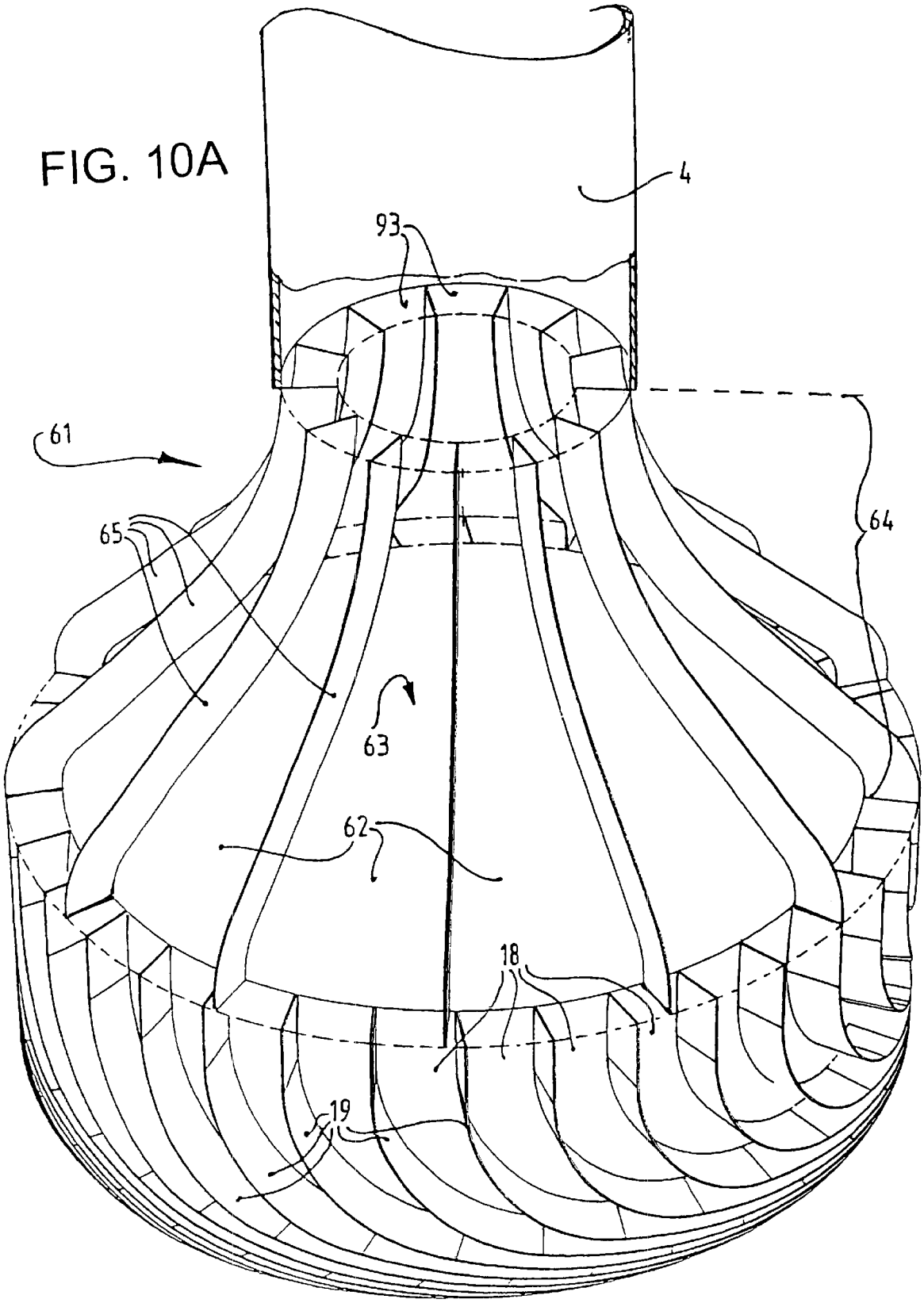
FIG. 10A shows a perspective view corresponding with FIG. 8 of the stator part of a fifth embodiment, wherein the manifold is embodied differently.

FIG. 10A shows a part of a fifth embodiment. Stator 61 is constructed to a large extent regularly and symmetrically and differs in this sense from the embodiments shown particularly clearly in FIGS. 2 and 7. In the embodiment of FIG. 10A manifold channels 62 are formed in analogous manner on stator channels 18. Manifold channels 62 are bounded on one side by a surface 63 of a second central body 64 tapering in the direction of outlet 4 and on the other side by the inner surface of a housing (not drawn). Channels 62 are mutually separated by dividing walls 65. As shown, about 2.7 stator channels are combined on average to form one manifold channel 62.

Figure 10B:
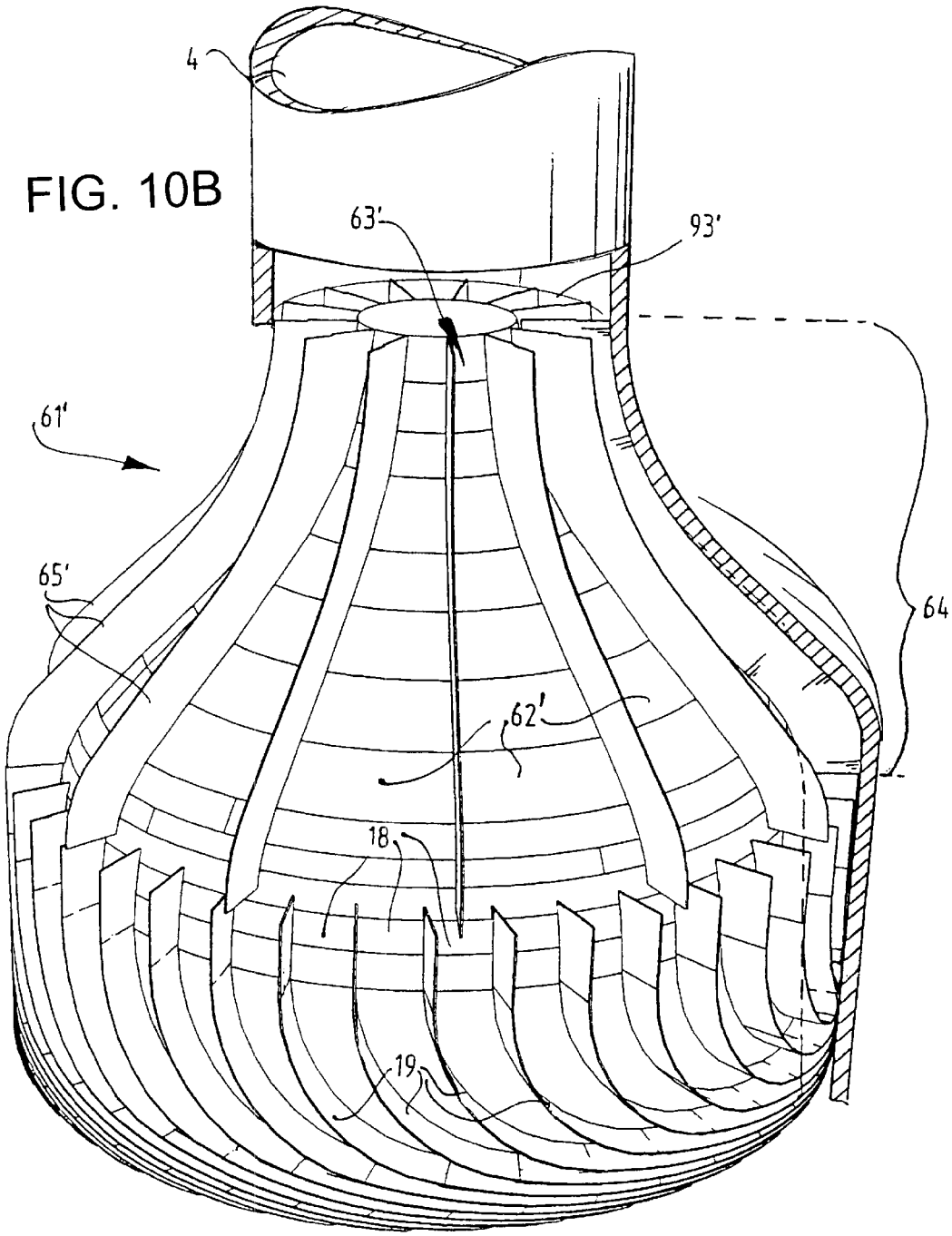
FIG. 10B shows a view corresponding with FIG. 10A of a variant.

FIG. 10B shows a variant of FIG. 10A. Stator 61' according to FIG. 10B differs from the embodiment of FIG. 10A to the extent that channels 62' are mutually separated by a surface 63' and baffles 65' with shapes differing from the relevant components in stator 61. The consequence hereof is that the medium passage 93' according to FIG. 10B has a larger passage than medium passage 93 in FIG. 10A. The difference in speed over channels 62' is therefore smaller than the difference in speed over channels 62. This may be desirable in some conditions.

Figure 10C:
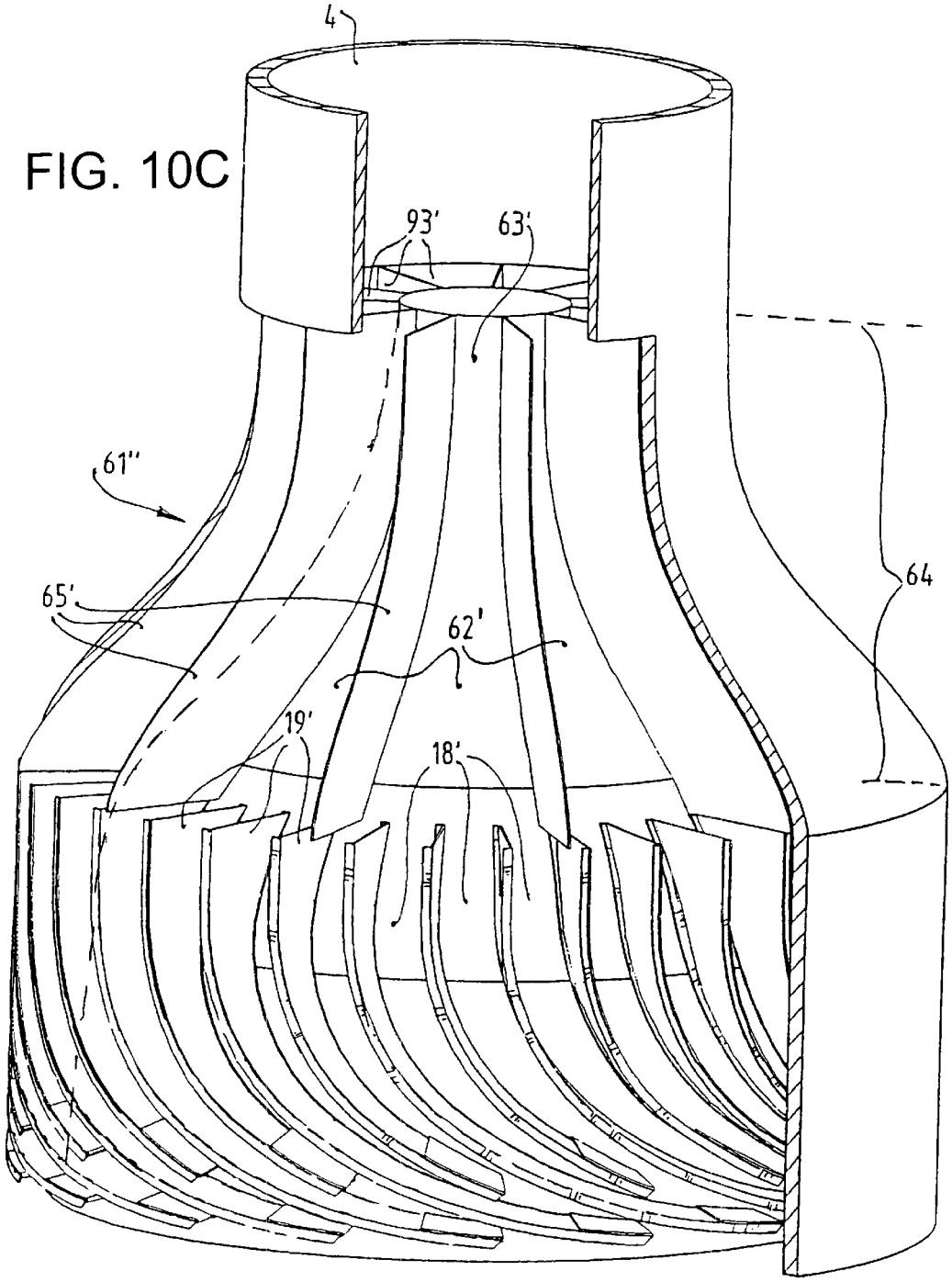
FIG. 10C shows a view corresponding with FIG. 10B of a variant.

FIG. 10C shows a further variant in which stator 61" comprises not only the relatively long baffles 19 but also shorter baffles 19' placed interwoven therewith. The effect hereof will be explained with reference to the following FIGS. 10D, 10E and 10F. Stator 61" otherwise substantially corresponds with stator 61'. It is pointed out that the lower end zones of baffles 19 and 19' are folded over. A good streamline form with increased stiffness, strength and erosion-resistance is hereby ensured.

Figure 10D:
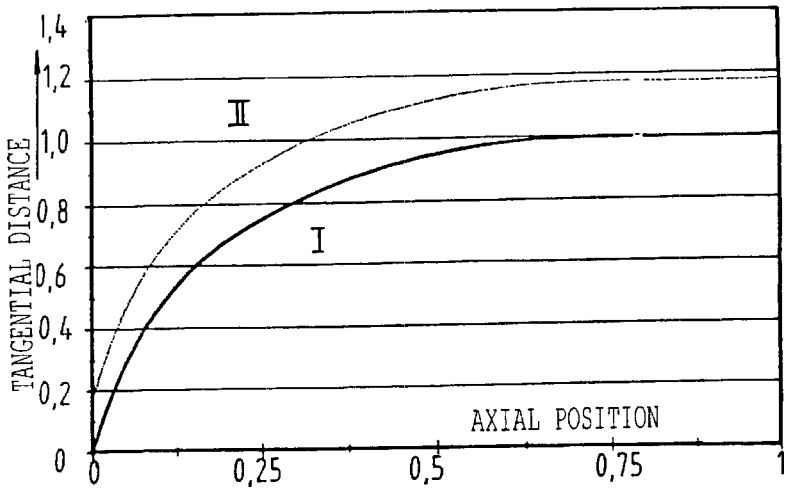
FIG. 10D is a graphic representation of the relation between the tangential distance between two blades and the axial position.

FIG. 10D shows the tangential distance between the adjacent baffles 19 and 19' according to FIG. 10C and the baffles 19 according to FIGS. 10A and 10B. The tangential distance is shown as a function of the axial position. Curves I and II correspond to adjacent baffles.

Figure 10E:
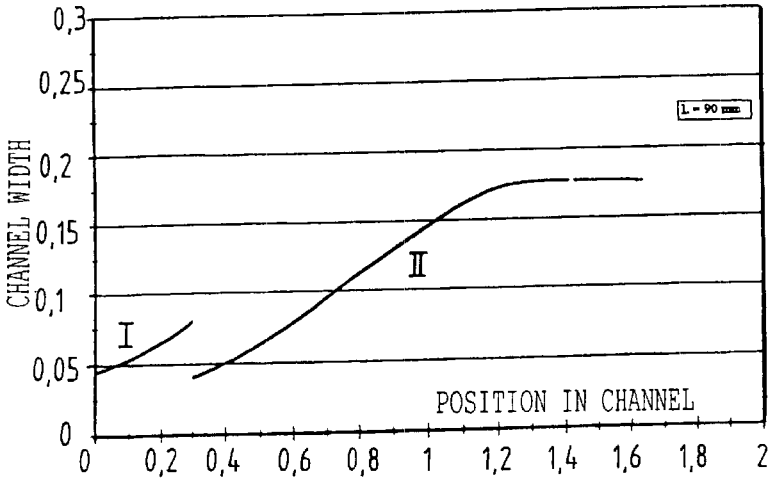
FIG. 10E shows the channel width as a function of the channel position.

FIG. 10E relates to the embodiment of FIG. 10C. The graph shows the channel width as a function of the channel position. The influence of the interwoven placing of relatively long and relatively short baffles is apparent. This influence is recognizable from the jump in the graph. If this jump were not present, the part designated II would then connect smoothly onto the part designated I, whereby the channel width in region II would become substantially larger. This would have a considerable effect on the elongate character of the stator channels, and thereby affect the performance of the device in question.

Figure 10F:
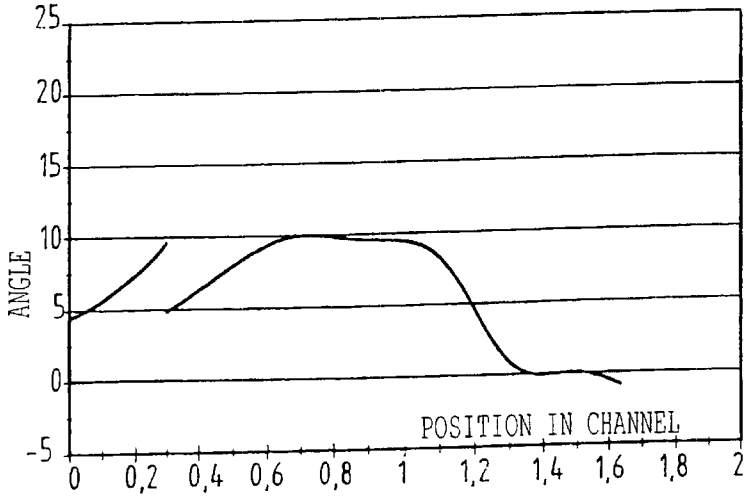
FIG. 10F is a graphic representation of the enclosed angle as a function of the channel position.

FIG. 10F shows the enclosed angle as a function of the channel position. A comparison with FIG. 5F shows that through the choice of interwoven placing of short and long baffles the enclosed angle, which in FIG. 5F amounts to almost 14°, is always smaller than 10° in the structure according to FIG. 10C.

Figure 11:
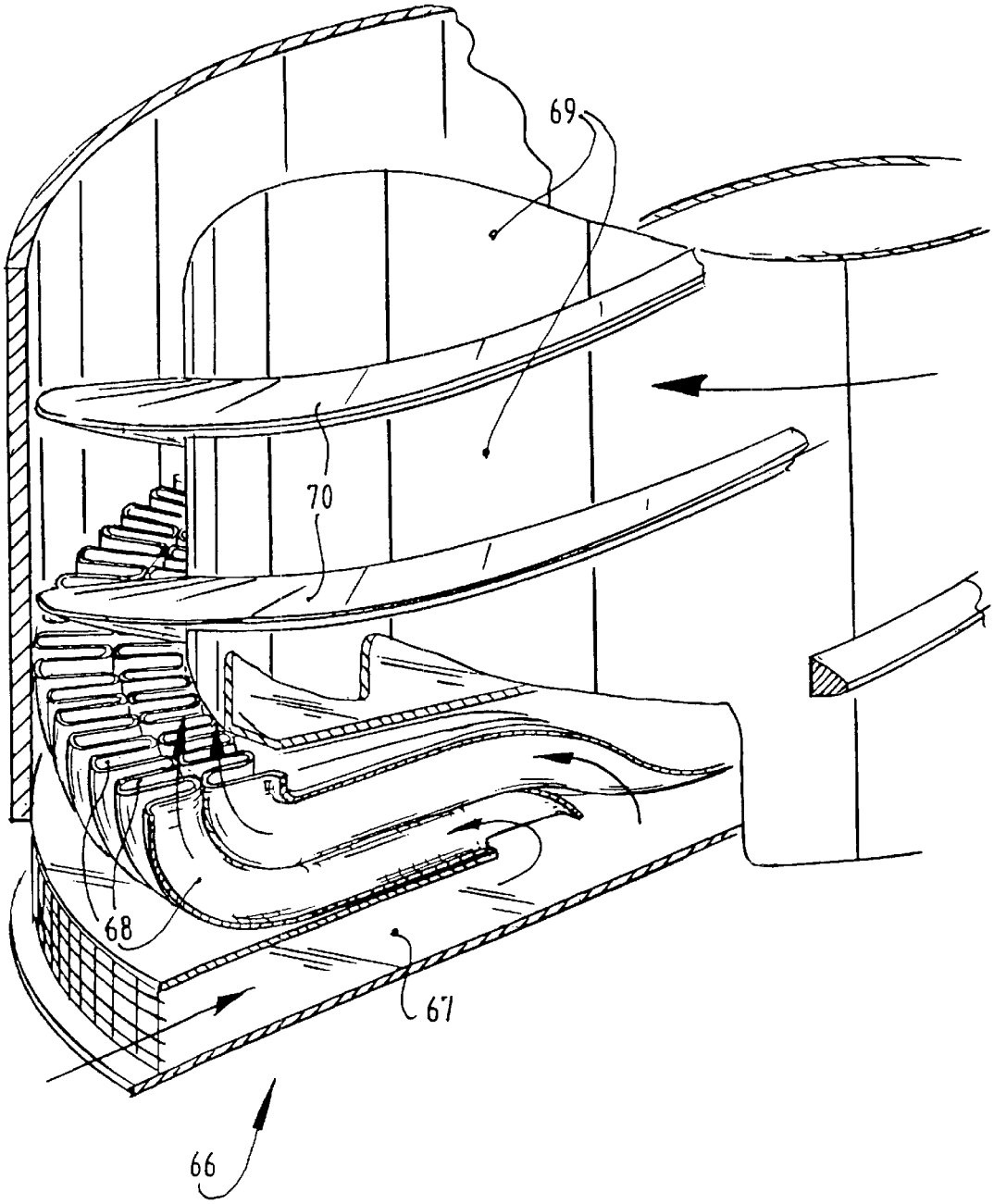
FIG. 11 is a partly broken away perspective view of a part of a sixth embodiment of a rotation device.

FIG. 11 shows a sixth embodiment. The rotation device 66 comprises a rotor 67 with a plurality of rotor channels 68 which are bounded by sheet-metal walls. This rotor can be formed by explosive deformation, by means of internal medium pressure, by means of a rubber press or other suitable known techniques. Manifold channels 69 are bounded by baffles 70 extending roughly helically in the drawn area.

FIG. 12 shows the manner in which the spatially very complicated form of the stator blades 19 can be manufactured from respective strips of stainless steel.

FIG. 12A shows very schematically a mould 71 for forming a stator blade 19 from a flat strip of steel of determined length. The mould comprises two mould parts 72, 73 which are rotatable with force relative to each other and which in a closed rotation position have two mutually facing separating surfaces, the shapes of which are substantially identical, which shapes correspond with the shape of a blade 19. The separating surface in question is situated at the position designated 74 where such a blade 19 is drawn in accordance with the reality during forming of a blade, wherein the adjoining parts of mould parts 72, 73 are drawn in broken away view. Shown at the bottom is the relevant separating surface 75 which continues in the shape of the blade 19. Arrows 76 show the relative rotatability of mould parts 72, 73. Guide blocks 76, 77 serve as guide for mould parts 72, 73 during the rotation. The mentioned means for rotatingly driving mould parts 72, 73 are not drawn.

In the open position of the mould, which is not drawn in FIG. 12*a,* a straight stainless steel strip is inserted. This strip is wholly flat and straight. The mould parts are then mutually rotated such that the moulding surfaces approach each other. Engaging of the strip hereby takes place with simultaneous deformation thereof. Reference is made in this respect to FIG. 12*b,* where the mutually co-acting mould parts 72, 73 are shown. As will be apparent, mould part 73 has on its underside adjoining support cylinder 77 a recess 78 corresponding with the bent lower edge 79 of strip 19, while a similar recess 80 remains present on the top side between the upper surface of mould part 72 and mould part 73 when the mould cavity is closed. The final closure of the mould cavity is determined exclusively by the thickness of the metal of blade 19. Recess 80 corresponds with the upper bent edge 81.

Figure 12C:
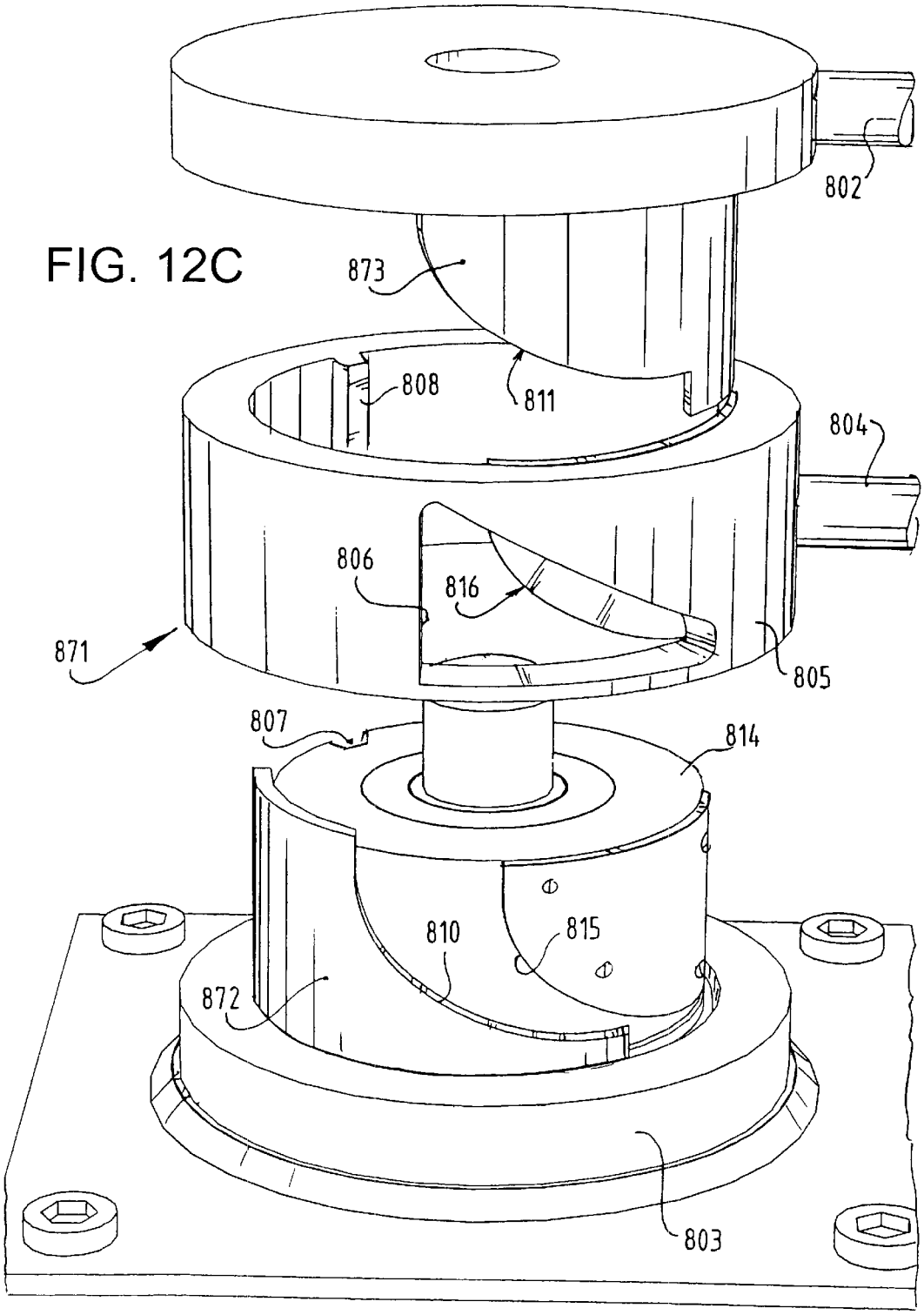
FIG. 12C shows a schematic exploded view of a device for manufacturing a stator blade.
Figure 12D:
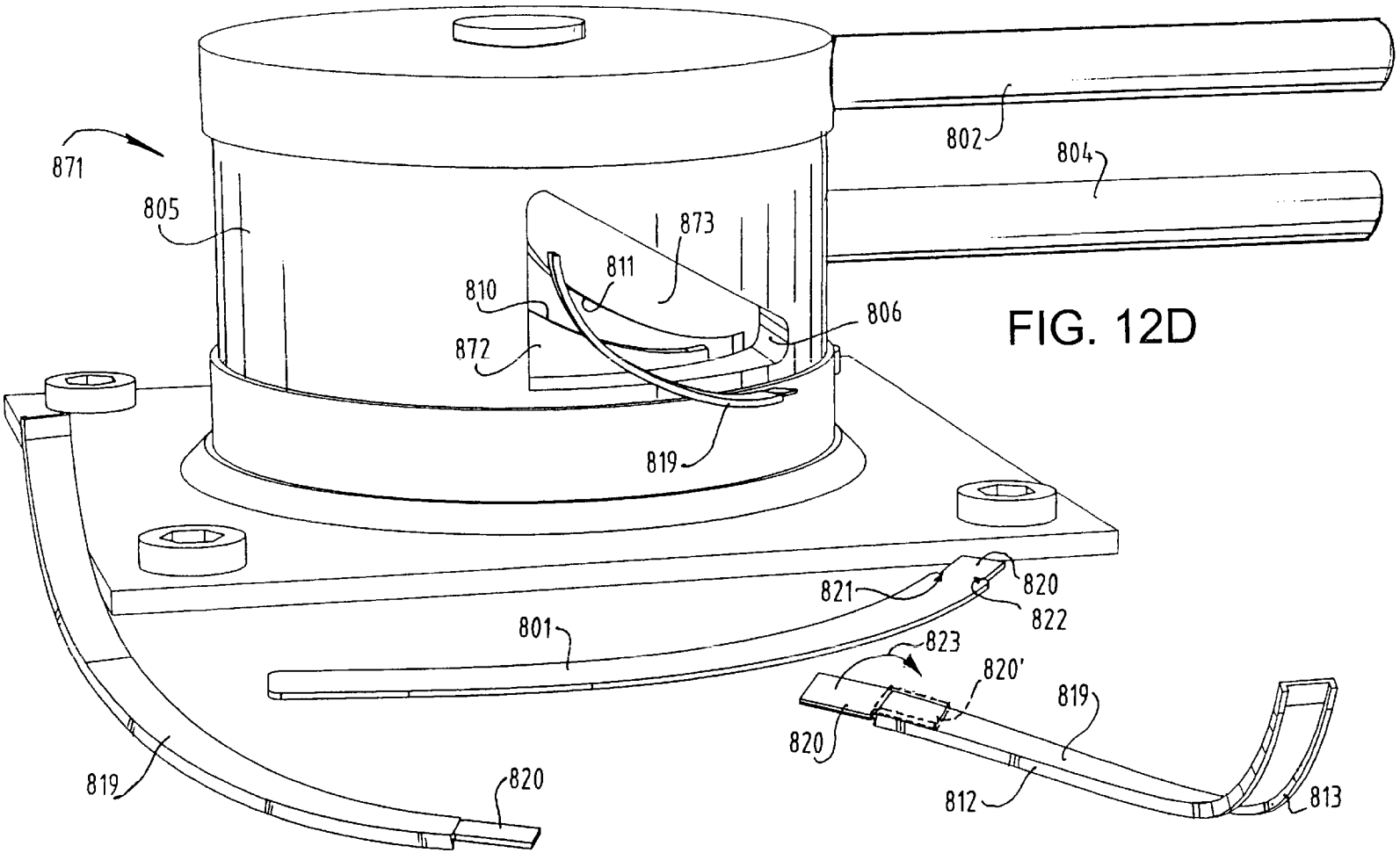
FIG. 12D is a perspective view of the device of FIG. 12C.

FIGS. 12C and 12D show an alternative device or mould 871 for forming a stator blade 819 from a flat strip of steel 801 with the curved form of determined length shown in FIG. 12D. Mould 871 comprises two mould parts 872, 873 which are rotatable with force relative to each other and which in a closed rotation position have two mutually facing separating surfaces, the shapes of which are substantially identical, which shapes correspond with the shape of a blade 819. The mutual rotation of said mould parts 872, 873 can take place by rotating mould part 873 by means of handle 802, wherein mould part 872 remains stationary because it is formed integrally with a frame 803 which is fixed to a work surface. A second handle 804 is fixed to a substantially cylindrical element 805 provided with a more or less triangular opening 806 which serves for placing of strip 801 and removal of a formed blade 819. The respective components 805 and 814 are mutually coupled for rotation by means of a key 808 fitting into a key way 807.

Said separating surfaces 810, 811 serve to impart to strip 801 the double curved principal shape, although without the bent edges 812, 813 which serve for connection of a blade deformation of a stator to respective cylindrical bodies. After this form has been obtained by rotation by middle handle 802, the bent edges 812, 813 can be formed by a further rotation by handle 804. During this further rotation the intended bending of said edges takes place due to rotation of central part 814 which, as stated, is coupled for rotation to element 805 and is provided with a bending edge 815. A second bending edge 816 is arranged on the inside of element 805.

With a very simple operation using device 871 a blade 819 can thus be made from the pre-formed metal strip 801.

It is noted that strip 801 is manufactured by laser cutting. A very accurate and chip- and burr-free sheet-metal element can hereby be obtained which is free of internal stresses. The narrowed end zone 820 can be folded over as according to arrow 823 to the position designated with 820'. Blade 819 is thereby ready to serve as component of a stator. Such a stator is shown for instance in FIG. 13C.

Figure 13A:
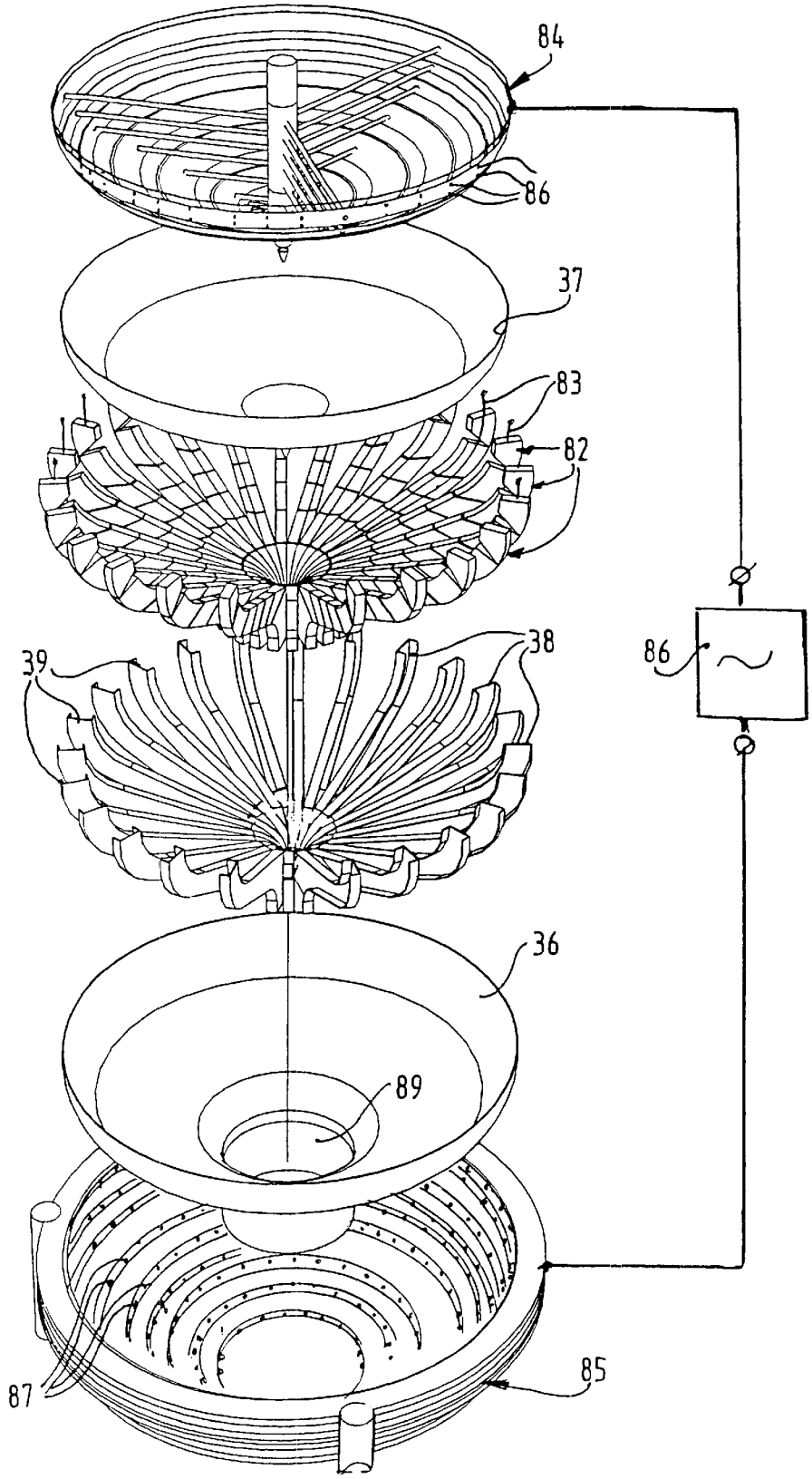
FIG. 13A shows a highly schematic exploded view of a device for assembling a rotor according to FIG. 9.

FIG. 13A shows a possible and very practical method of manufacturing rotor 8. The starting point is lower dish 36, upper dish 37 and the rotor baffles 38, 39 for placing therebetween and connecting fixedly thereto (see also FIG. 9).

In the exploded view of FIG. 13A is also shown that chains of similarly formed blocks 82 conducting electricity and heat can be incorporated in the three-dimensionally formed baffles 38, 39. These blocks are joined by wires 83 to form respective chains and can serve to conduct the current which can be conducted by an electrical power supply 86 via an upper electrode 84 and a lower electrode 85 through respectively dish 37, blocks 82, baffles 38, 39, lower dish 36 and lower electrode 85. By means of pressing means (not drawn) the dish-shaped electrodes 84, 85, the respective shapes of which correspond with respectively upper dish 37 and lower dish 36, are pressed with force to one another with corresponding pressing of the components mentioned and drawn in FIG. 3 at a mutual distance. Profiled zones 86 serving as pressing points are arranged in upper electrode 84. Corresponding zones 87 are arranged in lower electrode 84. During transmitting of a sufficiently large current, a large current will be conducted through the relevant current path via the pressing zones 86, 87, which are in register with baffles 38, 39. An effective spot welding of baffles 38, 39 to dishes 36, 37 hereby takes place. The for instance copper blocks 82 are essential for a good electrical conduction without adverse thermal effects on baffles 38, 39. After a spot-welding operation is thus completed, the relevant chains of blocks can be removed by pulling on wires 83. After this operation the rotor is in principle finished. As FIG. 1 shows, a fixing disc 90 can also be welded to upper dish 37 and with cover 91 this forms the fixing of the rotor to shaft 7. After the spot-welding operation as described above with reference to FIG. 13, the rotor according to FIG. 4 is provided with shores 35, whereafter shaft 37 is fixed.

FIG. 13B shows in greatly simplified manner and with the omission of a number of components an arrangement 830 for manufacturing a stator 831 as shown in FIG. 13C. For a good understanding of the arrangement of FIG. 13B, reference is first made to FIG. 13C. Stator 831 comprises a cylindrical inner wall 832 and a cylindrical outer wall 833. In this embodiment these walls are made of stainless steel. Outer wall 833 is relatively thick, while inner wall 832 is relatively thin. The stator blades 819 (see FIG. 12) of relatively great length and the blades 819' of shorter length placed interwoven therewith are placed in the desired position and fixed with the bent edges 812 and 813 to respectively inner wall 832 and outer wall 833 by welding. It will hereby be apparent that the shapes of these bent edges 812 and 813 must fit precisely onto the relevant cylindrical surfaces. The devices shown in FIG. 12 are specially designed herefor.

FIG. 13B shows, with the omission of cylinders 832, 833, an arrangement of equidistantly placed chains of copper blocks, which for the sake of convenience are all designated 834 and which take the form shown in FIG. 13D corresponding with the form of blades 819 respectively 819'. The blocks are mechanically connected to each other and electrically separated from each other by means of a lace 835. A rubber cushion 836 has a form such that the total structure 837, consisting of blocks 834, lace 835 and cushion 836, fits precisely between blades 819, 819' of a stator 831. Blocks 834 have a general U-shape. The edges 812, 813 can hereby be mutually connected for electrical conduction and thermal conduction without the electrical conduction taking place via the middle plate of a blade 819. Comparison of FIGS. 13B and 13C shows the relative placing of blocks 834 and blades 819, 819'.

FIG. 13B is drawn in simplified manner in the sense that only the foremost group of chains 837 is shown, while the cylindrical jackets 832, 833 have also been omitted for the sake of clarity. An outer electrode 838 is placed outside outer jacket 833, while an inner electrode 839 is placed inside inner jacket 832. These electrodes are adapted to simultaneously transmit currents through spot-welding zones, which for the sake of convenience are all designated 840. For this purpose electrodes 838, 839 are connected to a power source 841. After ordering of blades 819, 819' with interposing of chains 837 over the whole periphery with placing of both inner cylinder 832 and outer cylinder 833, the inner electrodes 839 and outer electrodes 838 are placed, whereafter the current flow is effected, which has the consequence that the bent edges 812, 813 are spot-welded at the current flow positions to inner cylinder 832 and outer cylinder 833. The respective chains 837 are subsequently pulled out from the top of the structure on laces 835, whereafter stator 831 is finished.

Figure 14:
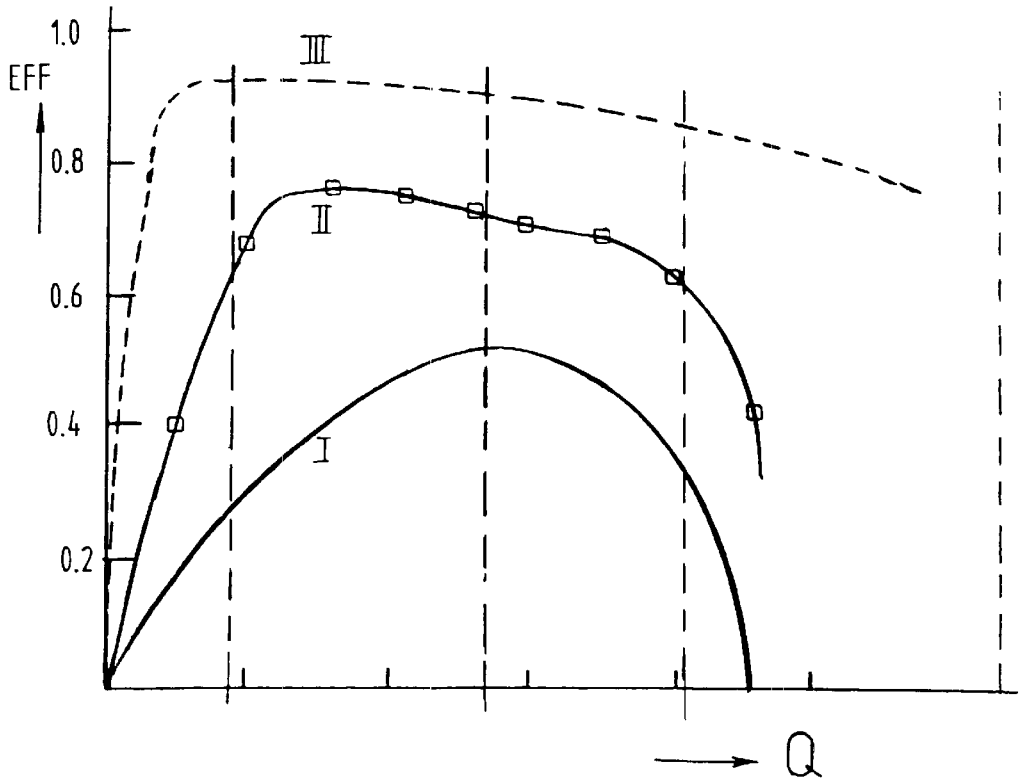
FIG. 14 shows a schematic graph comparing the efficiency as a function of the relative flow rate of a known rotation device and a device according to the present patent application.

FIG. 14 shows a graphic representation of the efficiency "EFF" expressed in a percentage as a function of the relative flow rate Q of respectively a device according to the prior art (graph I) and as measured on a device of the above described type according to FIG. 1 (graph II) and, finally, as according to FIGS. 7, 8, 9, 10. It will be apparent that the efficiency curve of the structure according to the invention is substantially higher than that of the prior art and has a considerably flatter progress. Particularly at lower rotation speeds the improvement is spectacular. This improvement explains why one device can be employed for many very varying applications. In the prior art different devices are usually required for different applications.

Figure 15:
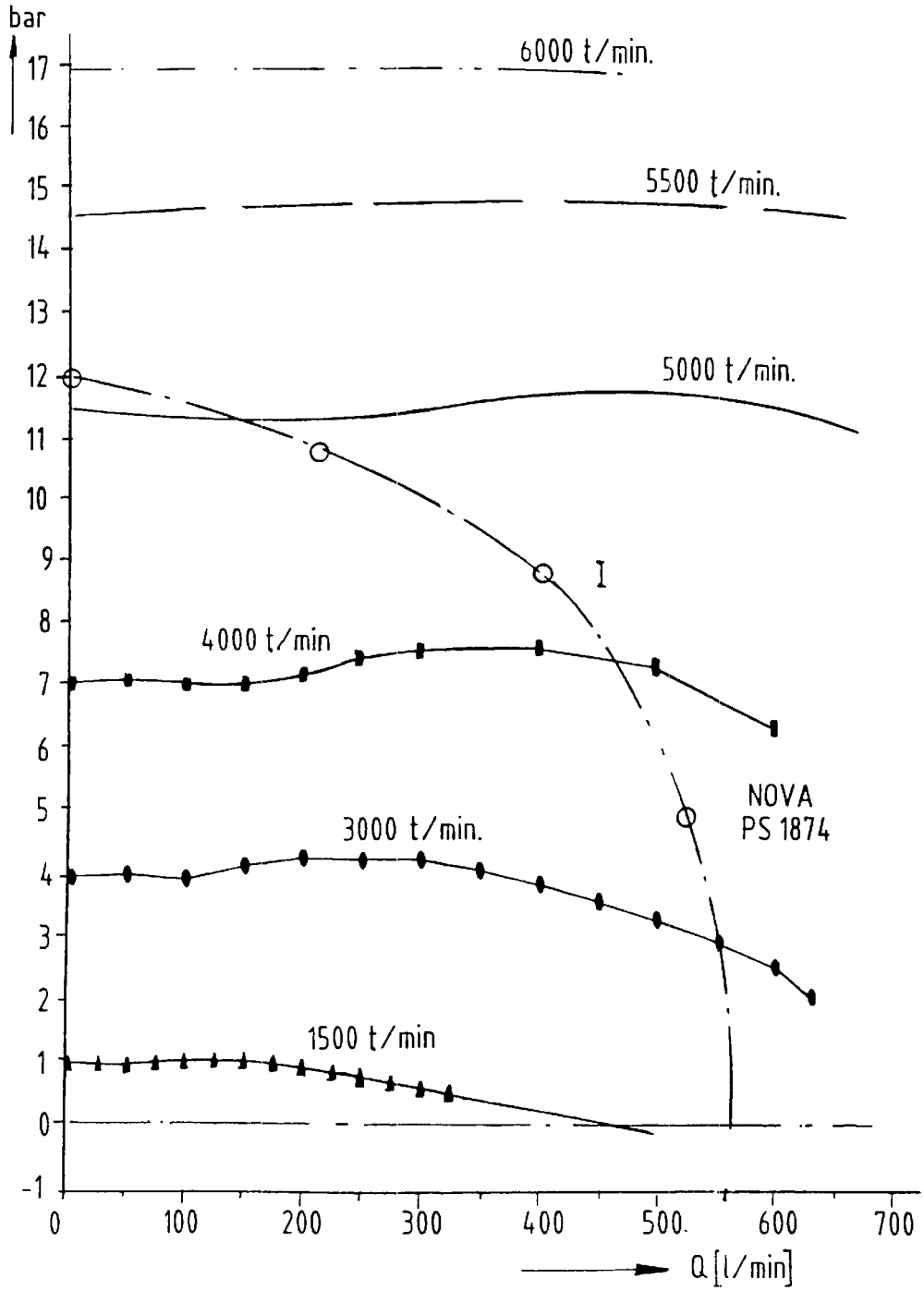
FIG. 15 shows the pressure to be generated by a device according to the invention as a function of the flow rate at different rotation speeds, as compared to a known pump.

FIG. 15 likewise shows the performance of a device according to the invention operating as a pump. The graphs shown in FIG. 15 relate to the pump pressure as a function of the flow rate of a device according to the invention compared to an eight-stage standard centrifugal pump with a dimensioning comparable to the device according to the invention. The graph I indicated with circular measurement points relates to the measurement on a known pump NOVA PS 1874. The other graphs relate to measurements on a pump according to the invention at the following rotation speeds of respectively: 1500, 3000, 4000, 5000, 5500, 6000 revolutions per minute.

Figure 16:
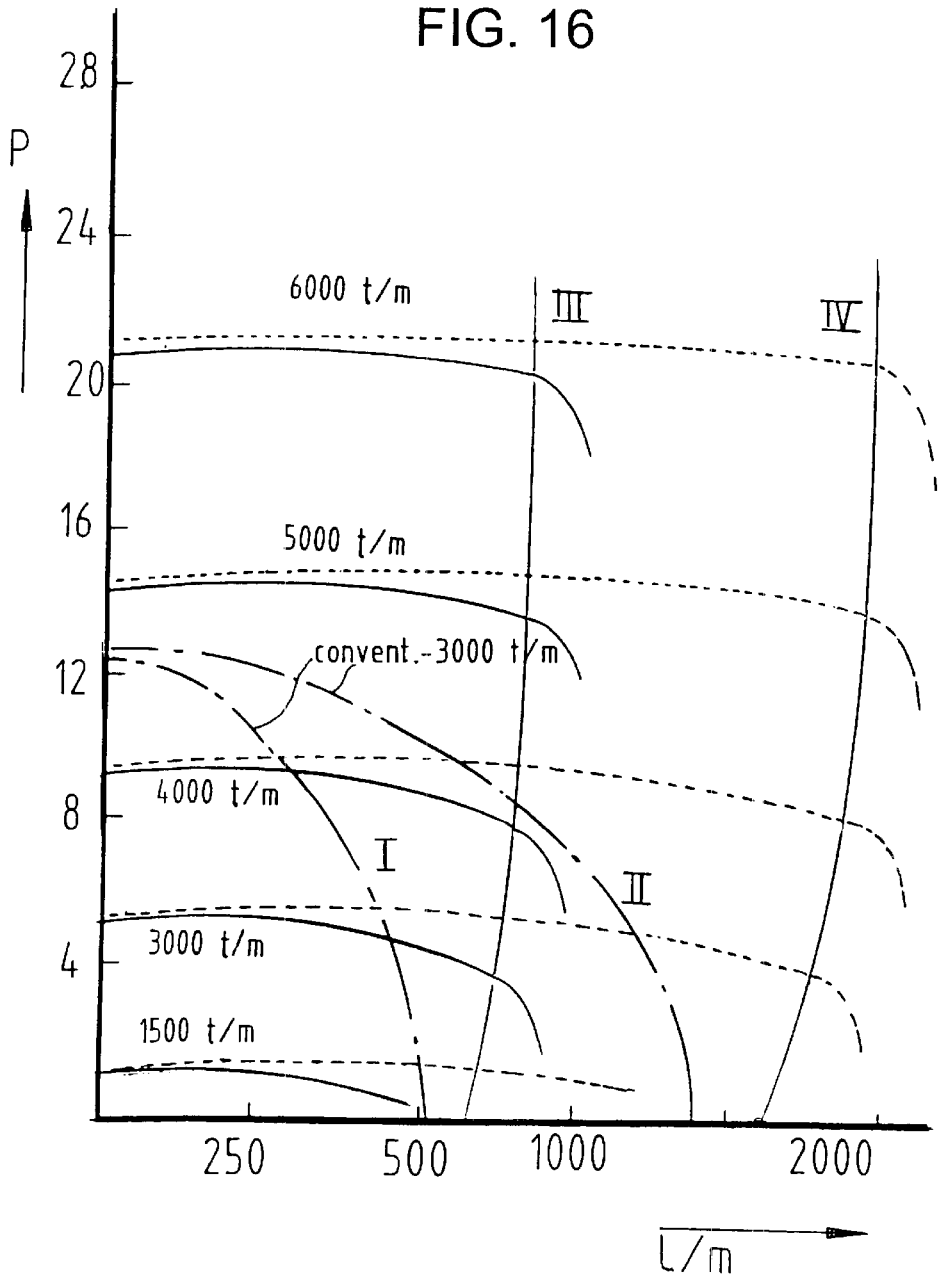
FIG. 16 is a graphic representation corresponding with FIG. 15 of another embodiment.

FIG. 16 shows measurement results in a comparison between two types of pump according to the invention and two types of pump according to the prior art. Graphs I and II relate to an eight-stage centrifugal pump of usual type at 3000 revolutions per minute. Graph I relates to an inlet of 58 mm while graph II relates to an inlet of 80 mm.

The drawn graphs with the indications of respectively 1500, 3000, 4000, 5000, 6000 revolutions per minute relate to a one-stage device according to the invention with a housing of 170 mm diameter, a rotor diameter of 152 mm and an inlet diameter of 38 mm. The graphs drawn in dashed lines likewise relate to a one-stage device according to the invention with a housing having a diameter of 170 mm, a rotor diameter of 155 mm and an inlet diameter of 60 mm.

The respective lines III and IV designate the respective cavitation boundaries of the first type of pump according to the invention as described and the second type of pump according to the invention as described.

It will be seen from the foregoing that the described new structure of a rotation device produces substantially better results than similar known devices. With particular reference to FIGS. 15 and 16, attention is once again drawn to the fact that the comparisons relate to a one-stage device according to the invention and an eight-stage device according to the prior art, i.e. eight known rotation devices connected in cascade.

Figure 17:
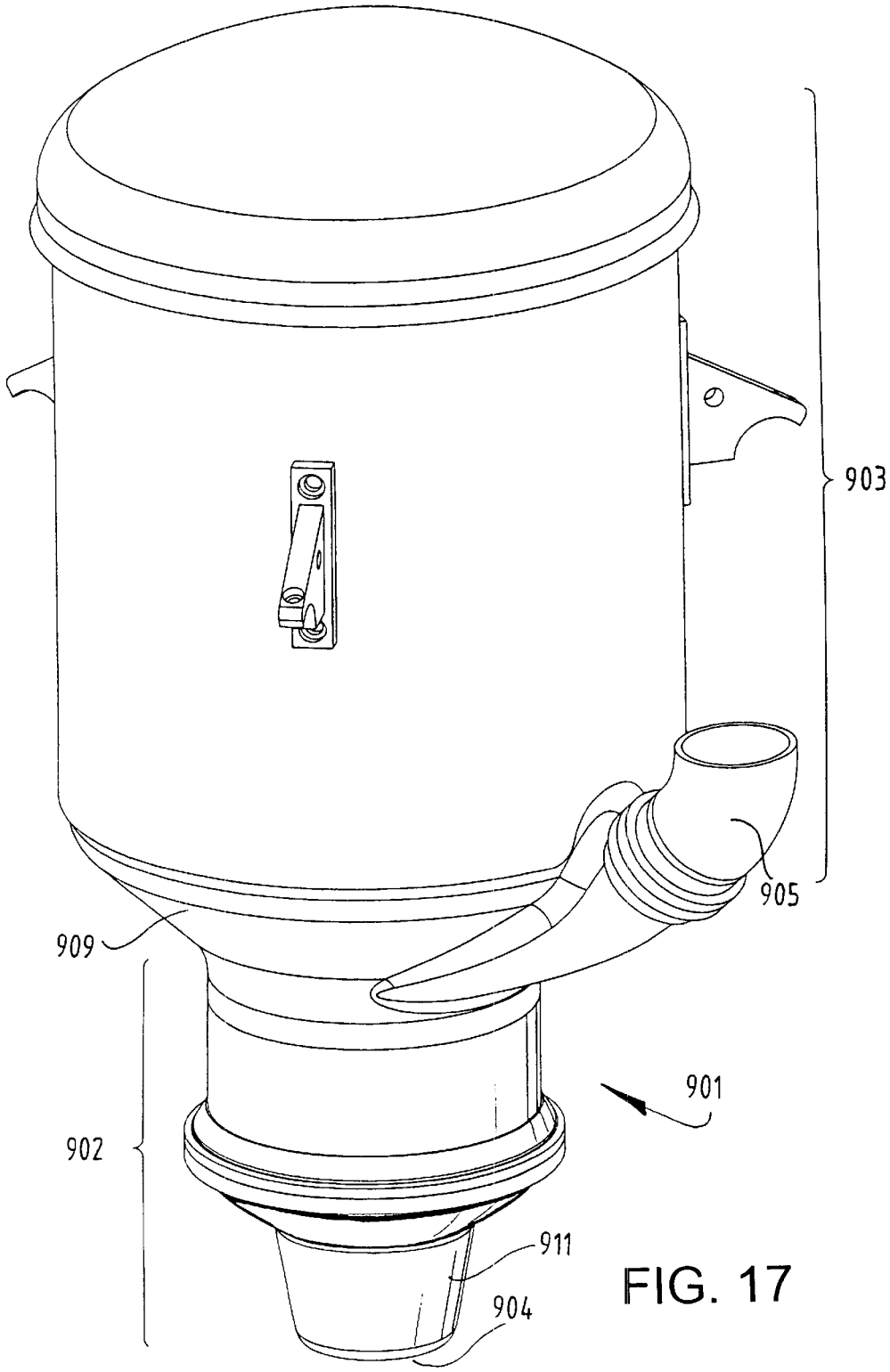
FIG. 17 is a perspective view of a further embodiment of the rotation device according to the invention.

FIG. 17 shows a unit 901 comprising a rotation device 902 and a motor 903. The unit is designed to operate as a pump. On the underside is situated a first medium passage 904 serving as inlet and on the side is situated the second medium passage 905 serving as outlet.

Figure 18:
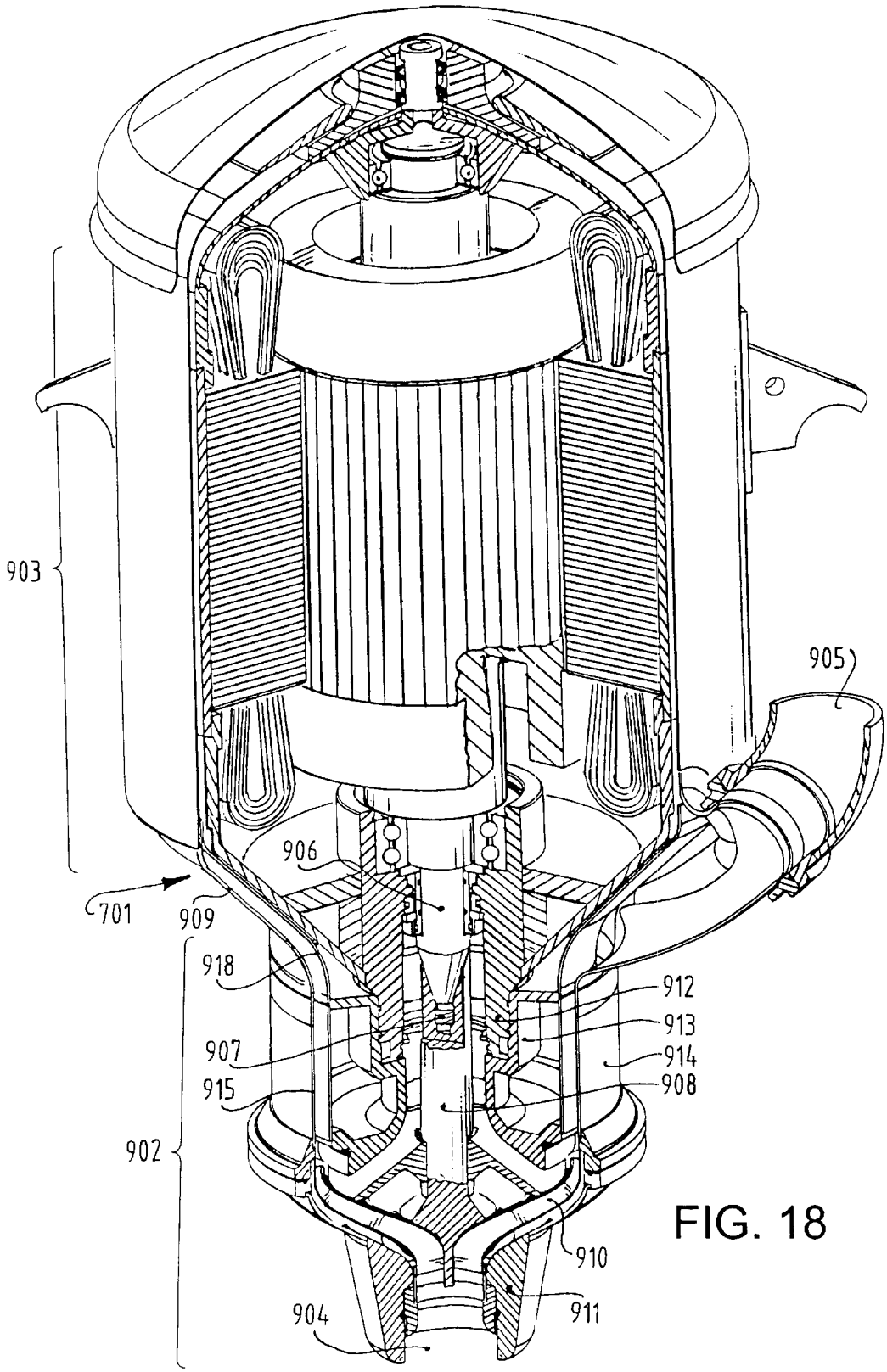
FIG. 18 is a cut-away perspective view of the device according to FIG. 17.

FIG. 18 shows schematically the structure of unit 901. At variance with the embodiment of for instance FIG. 4, in which the unit consists of a motor and a pump which in principle is connected inseparably thereto, unit 901 is constructed from two separate components. For this purpose motor shaft 906 has an end tapering towards the outside with a conical screw thread 907 on the end, while rotor shaft 908 has a corresponding complementary form. In this manner motor 903 and pump 902 are mutually coupled in releasable and power-transmitting manner, while a very easy release is nevertheless ensured. Particular reference will further be made below to the structure of a component of pump 902 with reference to FIGS. 21 and 22.

Figure 19:
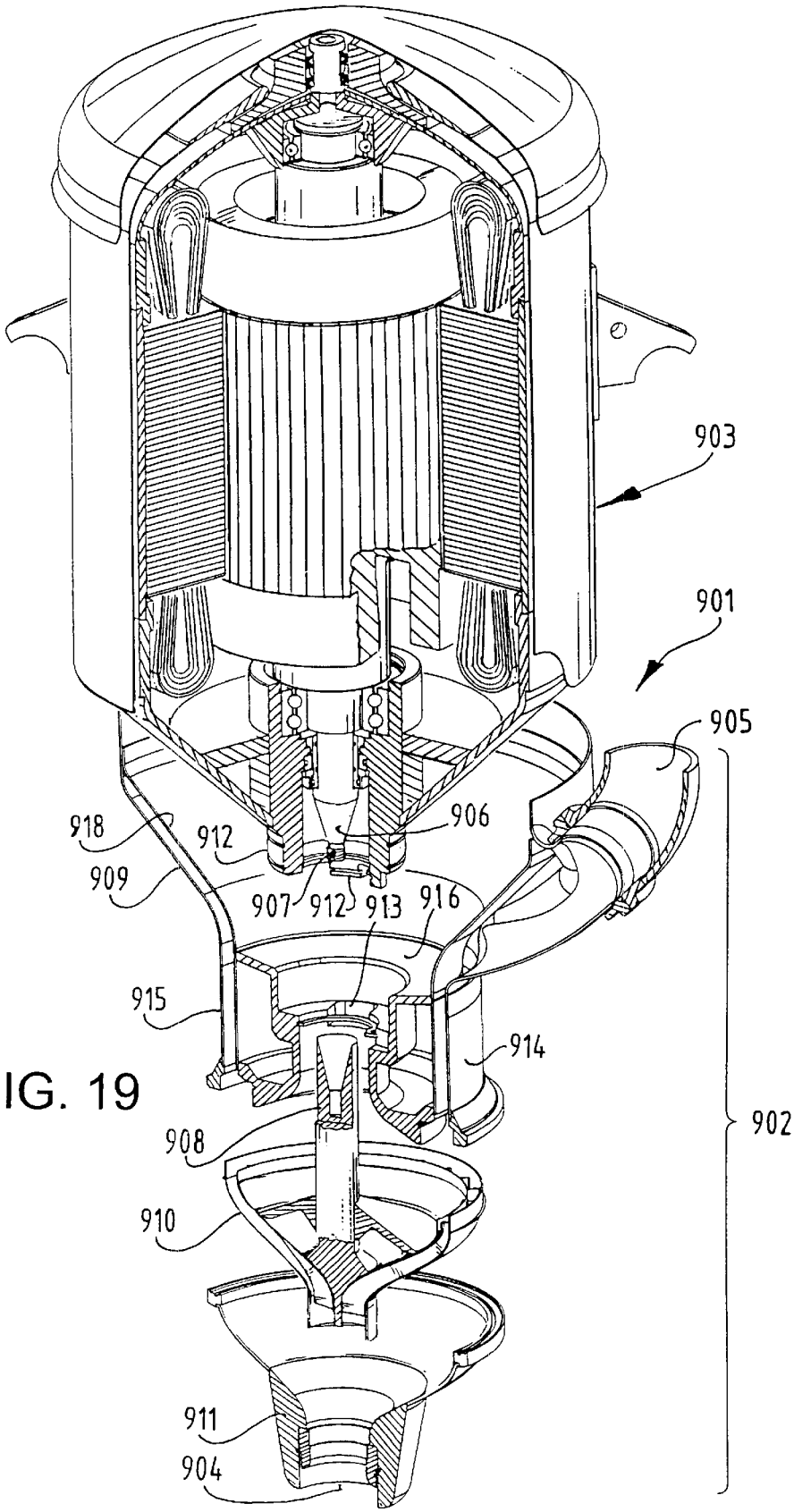
FIG. 19 shows an exploded view of the device of FIG. 17.

FIG. 19 shows in exploded view the manner in which the constituent main components are mutually connected and interrelated. It is important to note that upper component 909 of pump 902, in which the stator is situated, is constructed differently from the relevant components in the above described and shown embodiments. Rotor 910 and inlet components 911 correspond with the above described embodiments.

Figure 20:
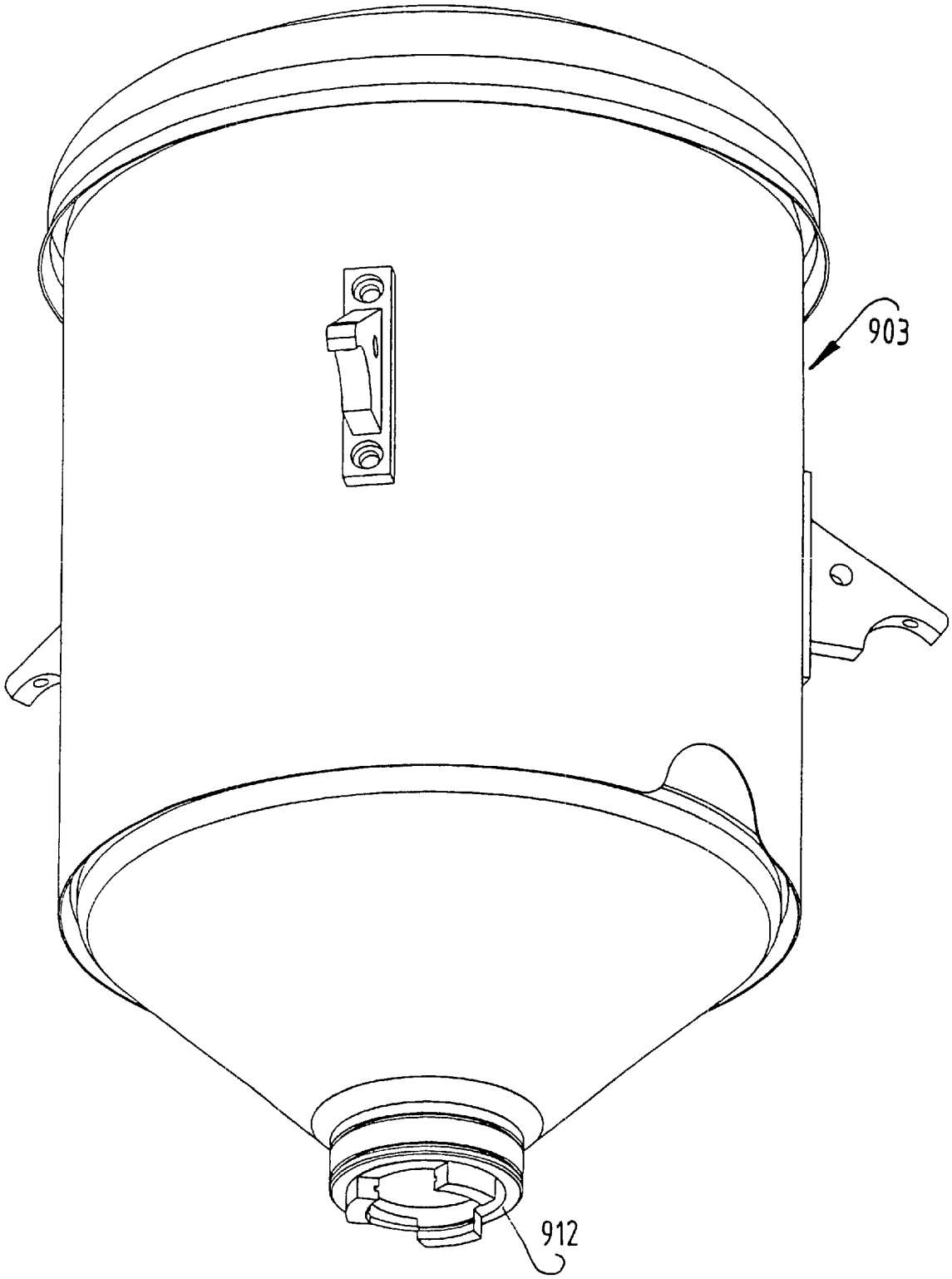
FIG. 20 is a perspective view of the motor.

FIG. 20 shows motor 903 with a coupling piece 912 on the underside for coupling to a corresponding coupling sleeve 913 on outlet component 909.

Figure 21:
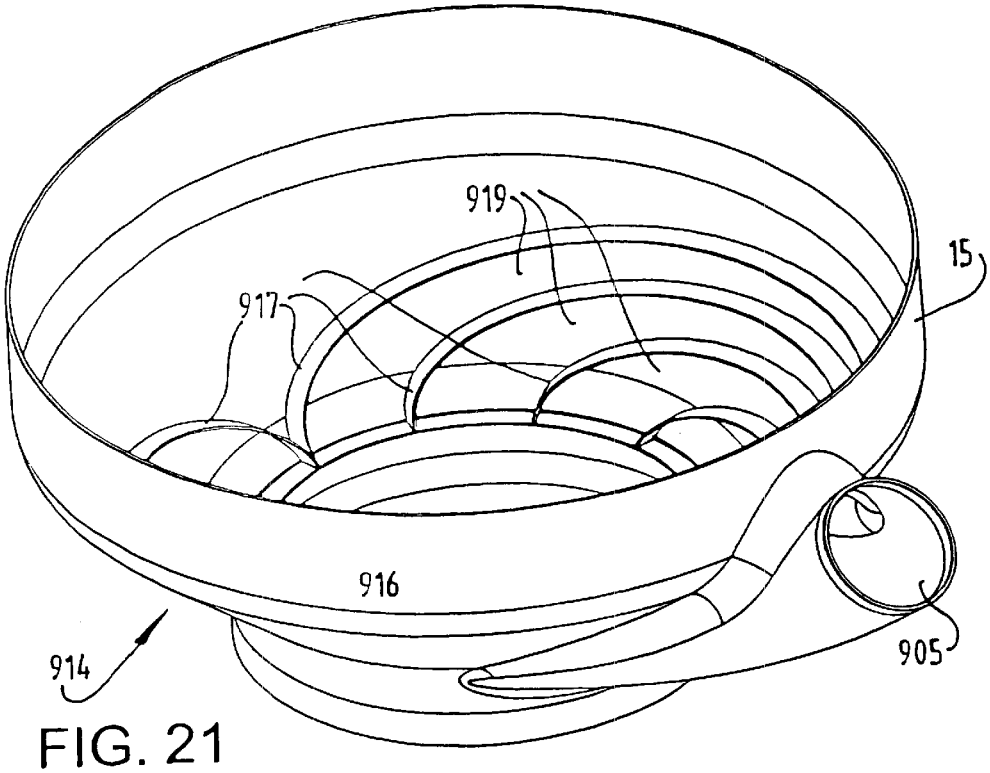
FIG. 21 is a perspective view of the unit of flow channels extending between the sixth medium passage and the second medium passage.
Figure 22:
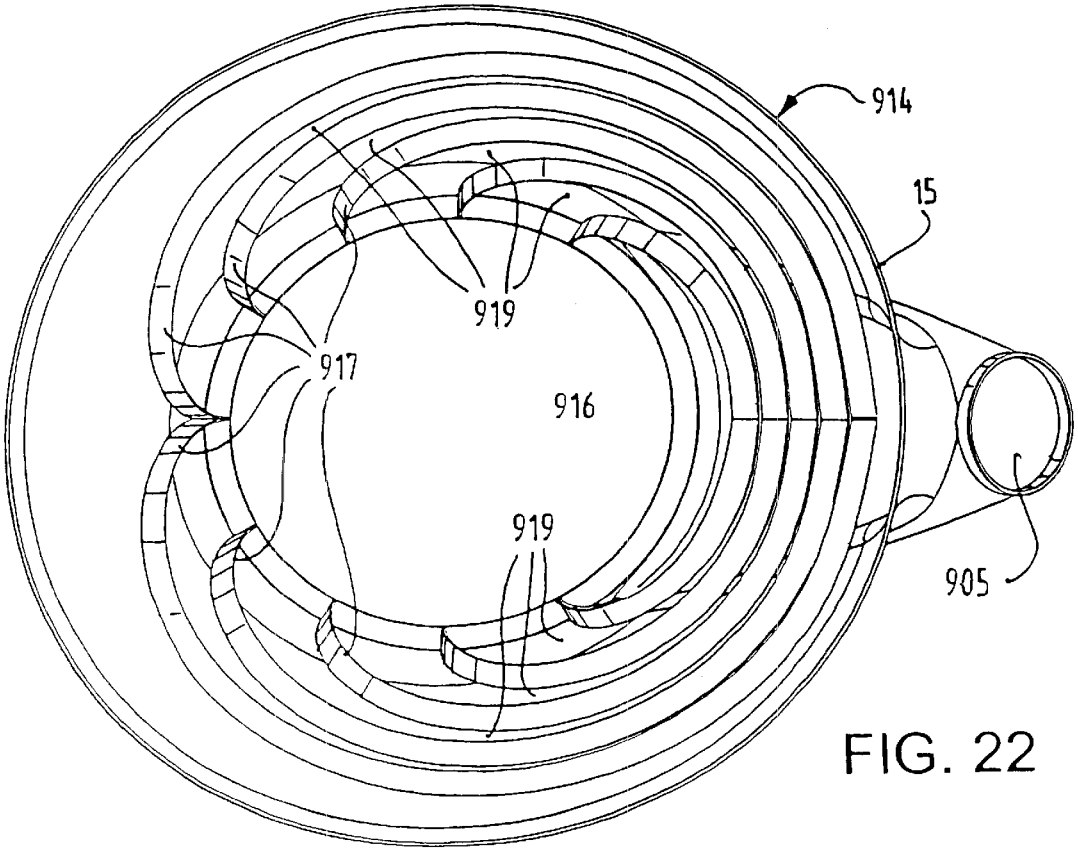
FIG. 22 shows a top view of the unit according to FIG. 21.

FIGS. 21 and 22 show a component 914 of outlet component 909. Component 914 comprises a sheet-metal funnel 915 with a central opening 916. Arranged against the wall in funnel 915 are flow guiding baffles which are ordered in the manner shown in FIGS. 21, 22 and which, although they possess different forms, are all designated for convenience with the reference numeral 917. Baffles 917 are members of one parametric family.

An inner funnel 918, likewise of sheet-metal, is situated inside funnel 915 such that flow guiding baffles 917 are bounded by the respective funnels 915 and 918 and thus form flow guiding channels 919. These latter all debouch into outlet 905 and ensure a controlled flow pattern with very low friction losses. Flow guiding baffles 917 can be made in a manner which is related to the manner in which the stator blades and/or the rotor baffles can be made. Reference is made to FIGS. 12 and 13 in respect of possible manufacturing methods.

The structure of unit 901 requires no further discussion. Both structure and operation will be apparent from the discussion of the foregoing embodiments.

Flow guiding channels 919 correspond functionally with manifold channels 62 and 62' of respectively FIGS. 10A and 10B. At variance with FIG. 10, the structure of unit 903 is such that outlet 905 extends on the side of unit 903. This simplifies the structure of the critical coupling between motor 903 and pump 902. It is however noted that in this respect the embodiment according to for instance FIGS. 1, 2 and 4 could also be applied.

Figure 23:
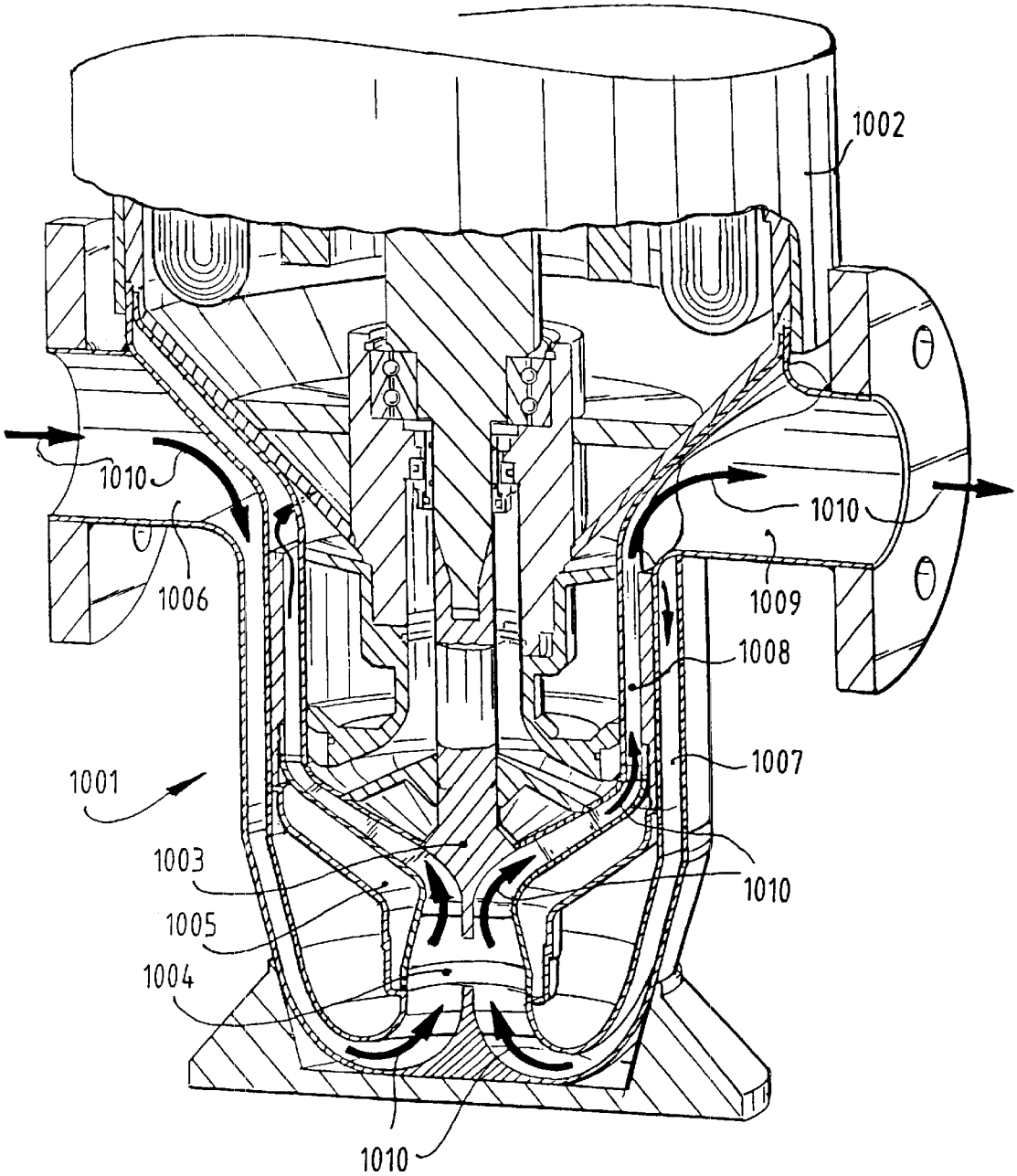
FIG. 23 is a cut-away perspective view of a variant.

FIG. 23 shows a pump 1001 with electric motor 1002 which drives rotor 1003. Inlet 1004 of stator 1005 connects onto a lateral inlet 1006 via a rotation-symmetrical transition zone 1007. Via a second rotation-symmetrical transition zone 1008 rotor 1003 connects onto a lateral outlet 1009, which in this embodiment is located coaxially relative to inlet 1006. Zones 1007 and 1008 lie in enveloping coaxial relation.

Attention is drawn to the fact that determined components such as blades and baffles are not drawn in FIG. 23.

Arrows 1010 show the medium flow.

What is claimed is:

1. A rotation device, comprising:

(a) a housing with a central, substantially axial first medium passage and at least one substantially axial second medium passage;

(b) a rotor shaft which extends in this housing and outside of this housing and which is mounted for rotation relative to this housing and supports a rotor accommodated in this housing, which rotor connects with a central third medium passage to said first medium passage, which third medium passage branches into a plurality of angularly equidistant rotor channels which each extend in a respectively generally radial main plane from the third medium passage to a respective fourth medium passage, wherein the end zone of the third medium passage and the end zone of the fourth medium passage each extend substantially axially and each rotor channel has a curved form with a middle part which extends in a direction having at least a considerable radial component, and each rotor channel has a flow tube cross-sectional surface which increases in the direction from the third medium passage to the fourth medium passage from a relative value of 1 to a relative value of at least 4;

(c) a stator accommodated in this housing and comprising:

(c.1) a first central body which has a substantially rotation-symmetrical outer surface with a smooth form which together with an inner surface of the housing bounds a generally substantially rotation-symmetrical medium passage space with a radial dimension of a maximum of 0.4 times the radius of said outer surface, in which medium passage space are accommodated a plurality of angularly equidistant stator blades which in pairs bound stator channels and which stator blades each have on their end zone directed toward the rotor and forming a fifth medium passage a direction differing substantially, in particular at least 60°, from the axial direction, and on their other end zone forming a sixth medium passage a direction differing little, in particular a maximum of 15°, from the axial direction; which fifth medium passages connect onto the fourth medium passages for medium flow in substantially axial direction and are placed at substantially the same radial positions, and which sixth medium passages connect onto the at least one second medium passage;

(c.2) a second central body, wherein between the sixth medium passage and the at least one second medium passage a plurality of manifold channels extend tapering in the direction from the sixth medium passages to the at least one second medium passage and bounded by the outer surface of the second central body and the cylindrical inner surface of the housing;

wherein a general medium through-flow path is defined between the first medium passage and the at least one second medium passage through respectively the first medium passage, the third medium passages, the rotor channels, the fourth medium passages, the stator channels, the sixth medium passages, the manifold channels, the second medium passages, and the vice versa, with substantially smooth and continuous transitions between parts during operation; and wherein the structure is such that during operation there is a mutual force coupling between the rotation of the rotor, and thus the rotation of the shaft and the pressure in the medium flowing through said medium through-flow path.

2. A device as claimed in claim 1, wherein the shaft is coupled for driving to a motor and the first medium passage is the medium inlet and the second medium passage is the medium outlet.

3. A device as claimed in claim 2, wherein an infeed propellor with a plurality of propellor blades is arranged in the third medium passage serving as medium inlet.

4. A device as claimed in claim 3, wherein each propellor blade connects to a baffle.

5. A device as claimed in claim 1, wherein the second medium passage is the medium inlet and is coupled to a source of medium under pressure and the first medium passage is the medium outlet.

6. A device as claimed in claim 1, wherein the medium is a liquid, suspension, or emulsion.

7. A device as claimed in claim 1, wherein the medium is a gas.

8. A device as claimed in claim 1, wherein the medium is a two-phase medium.

9. A device as claimed in claim 1, wherein the axial cross-section of each rotor channel has a form which corresponds generally to a half-cosine function.

10. A device as claimed in claim 1, wherein the number of rotor channels amounts to at least ten.

11. A device as claimed in claim 10, wherein the number of rotor channels amounts to at least twenty.

12. A device as claimed in claim 11, wherein the number of rotor channels amounts to at least forty.

13. A device as claimed in claim 1, wherein the number of rotor channels differs from the number of stator channels such that position coincidence of the fourth medium passages and the fifth medium passages is absent during rotation and therewith associated periodic pressure fluctuations in the medium flowing through the rotation device are thus prevented.

14. A device as claimed in claim 1, wherein the rotor comprises two dishes which, together with baffles also serving as spacers, bound the rotor channels.

15. A device as claimed in claim 14, wherein a first group of first baffles extends from the third medium passage to the fourth medium passage and at least one second group of second baffles is placed interwoven therewith, which second baffles extend from a position at a distance from the third medium passage to the fourth medium passage.

16. A device as claimed in claim 15, wherein said angle reaches a maximum value of 10°.

17. A device as claimed in claim 14, wherein the angle between a set of stator blades together forming a stator channel reaches a maximum value of 20° in a region between the fifth medium passage and the sixth medium passage.

18. A device as claimed in claim 17, wherein said angle reaches a maximum value of 10°.

19. A device as claimed in claim 14, wherein the dishes and the baffles consist of plate material made of at least one of plastic, plastic reinforced with fibres, aluminum, aluminum alloy, stainless steel and spring steel.

20. A device as claimed in claim 19, wherein the ratio of the rotor diameter and the thickness of the plate material has a value of 50–1600.

21. A device as claimed in claim 14, wherein the baffles are coupled to the dishes by at least one of welding, spot welding, glueing, soldering, magnetic forces, by means of screw connections, and lip/hole connections.

22. A device as claimed in claim 14, wherein the dishes are formed from metal by at least one of deep drawing, rolling, forcing, hydroforming, explosive deformation, and by means of a rubber press.

23. A device as claimed in claim 14, wherein the dishes are formed from plastic by at least one of injection moulding, thermo-forming, and thermovacuum-forming.

24. A device as claimed in claim 14, wherein each propellor blade connects to a baffle.

25. A device as claimed in claim 1, wherein the baffles extend from the third medium passage to a zone at a distance from the end zones of the dishes co-bounding the fourth medium passages.

26. A device as claimed in claim 1, wherein all surfaces coming into contact with medium are resistant to chemical and/or mechanical action by the medium.

27. A device as claimed in claim 1, wherein all surfaces coming into contact with medium are manufactured from materials and mutually connected for electrical conduction such that spark-forming is effectively prevented.

28. A device as claimed in claim 1, wherein all surfaces coming into contact with medium are made smooth in advance by at least one of grinding, polishing, honing and application of a coating of a carbide, a nitride, a titanium nitride, a boron nitride, glass, a silicate, high-grade plastics, or a polyimide.

29. A device as claimed in claim 1, wherein the stator blades consist of plate material made of at least one of plastic, plastic reinforced with fibres, aluminum, aluminum alloy, stainless steel and spring steel.

30. A device as claimed in claim 1, wherein the thermal expansion coefficients of the materials of the inner surface of the housing and of the stator blades are substantially the same.

31. A device as claimed in claims 30, wherein at least the inner surface of the housing consists of the same material as the stator blades.

32. A device as claimed in claim 1, wherein the stator channels are formed such that the distances between their mutually opposite walls are substantially the same at each axial position in a peripheral plane extending transversely of the axial direction.

33. A device as claimed in claim 1, wherein the shaft is solid and thus makes a substantial contribution to the mass moment of inertia of the rotatable unit comprising this shaft and said rotor.

34. A device as claimed in claim 1, wherein the rotor is manufactured from sheet-metal which is laid in at least two layers one over the other in a mould with a mould cavity having a form corresponding with the desired form of the rotor, between which two layers medium under pressure is admitted to cause expanding of the sheet material during plastic deformation against the wall of said mould cavity for forming of the rotor.

35. A device as claimed in claim 1, wherein the shaft is mounted for rotation relative to the housing in bearings which are located a great distance from the medium through-flow path such that possible large change in temperature of the through-flowing medium has no more than a negligible effect on the temperature of these bearings.

36. A device as claimed in claim 1, wherein the rotor is sealed relative to the housing by at least two labyrinth seals, whereof the one is situated in the region of the third medium passage and the other is situated in the region of the fourth medium passage.

37. A device as claimed in claim 1, wherein the number of stator blades amounts to at least 10.

38. A device as claimed in claim 37, wherein the number of stator blades amounts to at least 20.

39. A device as claimed in claim 1, wherein the ratio of the total cross-sectional surface of all fourth medium passages and the third medium passage amounts to at least 1.

40. A device as claimed in claim 39, wherein the ratio of the total cross-sectional surface of all fourth medium passages and the third medium passage amounts to at least 3.

41. A device as claimed in claim 40, wherein the ratio of the total cross-sectional surface of all fourth medium passages and the third medium passage amounts to at least 10.

42. A device as claimed in claim 1, wherein the ratio of the diameter of the ring of the fourth medium passages and the diameter of the third medium passage amounts to at least 1.5.

43. A device as claimed in claim 42, wherein the ratio of the diameter of the ring of the fourth medium passages and the diameter of the third medium passage amounts to at least 10.

44. A device as claimed in claim 43, wherein the ratio of the diameter of the ring of the fourth medium passages and the diameter of the third medium passage amounts to at least 20.

* * * * *